US008530132B2

(12) United States Patent
Yamamoto et al.

(10) Patent No.: US 8,530,132 B2
(45) Date of Patent: Sep. 10, 2013

(54) TONER, DEVELOPER USING THE TONER, METHOD FOR PREPARING THE TONER, AND IMAGE FORMING METHOD AND APPARATUS USING THE TONER

(75) Inventors: Atsushi Yamamoto, Shizuoka-ken (JP); Tsuyoshi Nozaki, Osaka-fu (JP); Chiyoshi Nozaki, Shiga-ken (JP)

(73) Assignee: Ricoh Company, Limited, Tokyo (JP)

( * ) Notice: Subject to any disclaimer, the term of this patent is extended or adjusted under 35 U.S.C. 154(b) by 400 days.

(21) Appl. No.: 13/040,019

(22) Filed: Mar. 3, 2011

(65) Prior Publication Data

US 2011/0217644 A1 Sep. 8, 2011

(30) Foreign Application Priority Data

Mar. 4, 2010 (JP) ..... 2010-047670

(51) Int. Cl.
*G03G 5/00* (2006.01)

(52) U.S. Cl.
USPC ..... 430/137.15; 430/137.17; 399/252

(58) Field of Classification Search
USPC ..... 430/137.15, 137.17; 399/252
See application file for complete search history.

(56) References Cited

U.S. PATENT DOCUMENTS

| | | | |
|---|---|---|---|
| 4,221,862 | A | 9/1980 | Naito et al. |
| 5,133,992 | A | 7/1992 | Nair et al. |
| 7,005,480 | B2 | 2/2006 | Kinsho et al. |
| 7,550,242 | B2 | 6/2009 | Nozaki et al. |
| 7,556,904 | B2 | 7/2009 | Kadota et al. |
| 7,556,906 | B2 | 7/2009 | Katoh et al. |
| 7,632,619 | B2 | 12/2009 | Mikuriya et al. |
| 7,635,549 | B2 | 12/2009 | Nakamura et al. |
| 7,678,522 | B2 | 3/2010 | Nakamura et al. |
| 7,695,885 | B2 | 4/2010 | Yasunaga et al. |
| 7,709,171 | B2 | 5/2010 | Yamamoto et al. |
| 7,749,671 | B2 | 7/2010 | Yamamoto et al. |
| 7,785,760 | B2 | 8/2010 | Yamamoto et al. |
| 7,811,735 | B2 | 10/2010 | Nakamura et al. |
| 7,829,254 | B2 | 11/2010 | Kurose et al. |
| 7,833,686 | B2 | 11/2010 | Kadota et al. |
| 7,838,193 | B2 | 11/2010 | Hagi et al. |
| 7,862,896 | B2 | 1/2011 | Akutagawa et al. |
| 7,867,682 | B2 | 1/2011 | Nozaki et al. |
| 7,867,685 | B2 | 1/2011 | Murakami et al. |
| 2007/0015851 | A1 | 1/2007 | Akutagawa et al. |
| 2007/0026335 | A1 | 2/2007 | Yamamoto et al. |
| 2007/0207399 | A1 | 9/2007 | Kadota et al. |
| 2007/0212630 | A1 | 9/2007 | Yasunaga et al. |

(Continued)

FOREIGN PATENT DOCUMENTS

| | | |
|---|---|---|
| JP | 61-28688 | 7/1986 |
| JP | 63-25664 | 2/1988 |

(Continued)

*Primary Examiner* — Mark A Chapman
(74) *Attorney, Agent, or Firm* — Oblon, Spivak, McClelland, Maier & Neustadt, L.L.P.

(57) ABSTRACT

A method for preparing a toner including toner particles is provided. The toner preparation method includes preparing a toner component liquid including at least a binder resin, a colorant and an organic solvent; mixing a resin A having a solubility of less than 2.0 g/100 g in water having a pH of 3.0 at 25° C. while having a solubility of not less than 2.0 g/100 g, a basic material, and water to prepare an aqueous phase liquid, in which the resin A is dissolved; forming droplets of the toner component liquid in the aqueous phase liquid; and removing the organic solvent from the droplets of the toner component liquid to prepare the toner particles.

19 Claims, 3 Drawing Sheets

(56) References Cited

U.S. PATENT DOCUMENTS

| | | | |
|---|---|---|---|
| 2007/0217842 | A1 | 9/2007 | Kato et al. |
| 2007/0218384 | A1 | 9/2007 | Matsumoto et al. |
| 2007/0218390 | A1 | 9/2007 | Nozaki et al. |
| 2008/0069617 | A1 | 3/2008 | Matsumoto et al. |
| 2008/0076054 | A1 | 3/2008 | Nozaki et al. |
| 2008/0096119 | A1 | 4/2008 | Yamamoto et al. |
| 2008/0101823 | A1 | 5/2008 | Katoh et al. |
| 2008/0131797 | A1 | 6/2008 | Ishikawa et al. |
| 2008/0176159 | A1 | 7/2008 | Matsumoto et al. |
| 2008/0220357 | A1 | 9/2008 | Nozaki et al. |
| 2008/0227001 | A1 | 9/2008 | Kadota et al. |
| 2008/0227013 | A1 | 9/2008 | Kadota et al. |
| 2008/0227016 | A1 | 9/2008 | Nozaki et al. |
| 2008/0232857 | A1 | 9/2008 | Matsumoto et al. |
| 2008/0233497 | A1 | 9/2008 | Yamamoto et al. |
| 2008/0233510 | A1 | 9/2008 | Nozaki et al. |
| 2008/0233511 | A1 | 9/2008 | Ishikawa et al. |
| 2009/0017391 | A1 | 1/2009 | Yamamoto et al. |
| 2009/0186289 | A1 | 7/2009 | Nakamura et al. |
| 2009/0220879 | A1 | 9/2009 | Matsumoto et al. |
| 2009/0232542 | A1 | 9/2009 | Yamamoto et al. |
| 2009/0233199 | A1 | 9/2009 | Nozaki et al. |
| 2009/0257792 | A1 | 10/2009 | Nakamura et al. |
| 2009/0297975 | A1 | 12/2009 | Ishikawa et al. |
| 2009/0297976 | A1 | 12/2009 | Yamamoto et al. |
| 2010/0055603 | A1 | 3/2010 | Nozaki et al. |
| 2010/0068646 | A1 | 3/2010 | Yamamoto |
| 2010/0150609 | A1 | 6/2010 | Nozaki et al. |
| 2010/0227265 | A1 | 9/2010 | Matsumoto et al. |
| 2010/0239974 | A1 | 9/2010 | Nozaki et al. |
| 2010/0272481 | A1 | 10/2010 | Yamamoto et al. |
| 2010/0296848 | A1 | 11/2010 | Yamamoto et al. |

FOREIGN PATENT DOCUMENTS

| | | |
|---|---|---|
| JP | 2-43225 | 2/1990 |
| JP | 3455523 | 7/2003 |
| JP | 4134057 | 6/2008 |
| JP | 2008-225410 | 9/2008 |

TONER, DEVELOPER USING THE TONER, METHOD FOR PREPARING THE TONER, AND IMAGE FORMING METHOD AND APPARATUS USING THE TONER

BACKGROUND OF THE INVENTION

1. Field of the Invention

The present invention relates to a toner for use in electrophotographic image formation, and to a method for preparing the toner. In addition, the present invention relates to a developer, an image forming method and an image forming apparatus using the toner.

2. Description of the Related Art

Various researches and developments have been made for electrophotography. Electrophotographic image forming methods typically include the following processes:

(1) Charging an image bearing member such as a photoreceptor (Charging process);

(2) Irradiating the image bearing member with light to form an electrostatic latent image on the image bearing member (irradiating process);

(2) Developing the electrostatic latent image with a developer including a toner to form a toner image on the image bearing member (developing process);

(3) Transferring the toner image onto a recording material such as paper sheets (transferring process); and (4) Fixing the toner image on the recording material upon application of heat and pressure or the like thereto, resulting in formation of an output image (fixing process).

Contact heat fixing methods such as heat roller fixing methods have been typically used for the fixing process. Fixing devices for use in the heat roller fixing methods include a heat roller and a pressure roller, and a recording material bearing a toner image is fed through a nip between the heat roller and the pressure roller so that the toner image is melted and fixed on the recording material.

It is preferable for the toner used for developing electrostatic latent images to include a polyester resin, which has an advantage in fixing property, and to have a spherical form while having a particle diameter of about few micrometers and a sharp particle diameter distribution so as to produce high definition images.

In order to prepare such a preferable toner, solution suspension methods, in which toner components such as a binder resin (e.g., polyester), a colorant and a release agent are dissolved or dispersed in an organic solvent to prepare a toner component liquid (i.e., oil phase liquid), and the toner component liquid is dispersed in an aqueous medium to prepare a colored particulate material (i.e., toner particles), and emulsion association methods, in which particulate toner components such as a particulate resin (e.g., particulate polyester), a particulate colorant and a particulate release agent are aggregated in the presence of a flocculating salt or the like, followed by a reshaping treatment to prepare a colored particulate material have been proposed.

In order to prepare a colored particulate material having a sharp particle diameter distribution using the solution suspension methods, techniques such that a fine particulate resin is dispersed in an aqueous medium to stably disperse a toner component liquid in the aqueous medium have been proposed. Specifically, there is a proposal for a technique in that a resin solution serving as an oil phase liquid is dispersed in an aqueous medium, in which a fine particulate resin is dispersed, to prepare a particulate resin having a sharp particle diameter distribution.

However, the toner preparation methods for stably dispersing an oil phase liquid in an aqueous phase liquid using a fine particulate resin have a drawback such that the dispersing conditions of the oil phase liquid in the aqueous medium change depending on the properties of such a fine particulate resin such as particle diameter and zeta potential. In other words, the properties of the fine particulate resin have to be severely controlled to control the conditions of the oil phase liquid dispersed in the aqueous medium. Therefore, it is difficult for the toner preparation methods to stably produce a desired toner.

For these reasons, the present inventors recognized that there is a need for a solution suspension method by which a particulate material (such as toner) having desired properties can be stably produced.

SUMMARY

This patent specification describes a novel method for preparing a toner including toner particles. The method includes preparing a toner component liquid including at least a binder resin, a colorant and an organic solvent; mixing at least a resin A having a solubility of less than 2.0 g/100 g in water having a pH of 3.0 at 25° C. while having a solubility of not less than 2.0 g/100 g, a basic material, and water to prepare an aqueous phase liquid, in which the resin A is dissolved; forming droplets of the toner component liquid in the aqueous medium; and removing the organic solvent form the droplets of the toner component liquid to prepare the toner particles.

This patent specification further describes a novel toner including at least a binder resin and a colorant, and prepared by the above-mentioned toner preparation method.

This patent specification further describes a novel developer (two component developer) including the above-mentioned toner and a carrier. The toner mentioned above can also be used as a one component developer.

This patent specification further describes a novel image forming method, one embodiment of which includes charging an image bearing member; irradiating the charged image bearing member with light based on image data to form an electrostatic latent image on the image bearing member; developing the electrostatic latent image with a developer including the above-mentioned toner to form a toner image on the image bearing member; transferring the toner image onto a recording material; and fixing the toner image on the recording material.

This patent specification further describes a novel image forming apparatus, one embodiment of which includes an image bearing member; a charger to charge a surface of the image bearing member; an irradiator to irradiate the charged image bearing member with light based on image data to form an electrostatic latent image on the image bearing member; a developing device to develop the electrostatic latent image with a developer including the above-mentioned toner to form a toner image on the image bearing member; a transferring device to transfer the toner image onto a recording material; and a fixing device to fix the toner image on the recording material.

BRIEF DESCRIPTION OF THE DRAWINGS

Amore complete appreciation of the aspects of the invention and many of the attendant advantage thereof will be readily obtained as the same better understood by reference to the following detailed description when considered in connection with the accompanying drawings, wherein.

DESCRIPTION OF THE PREFERRED EMBODIMENTS

Figure 1:
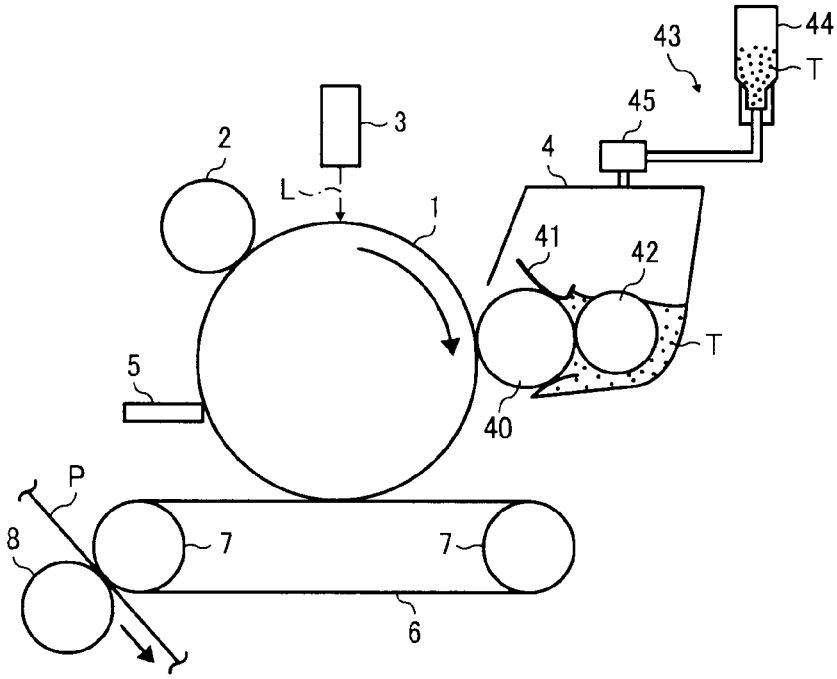
FIG. 1 is a schematic view illustrating the main portion of an example of the image forming apparatus of the present invention, for which the toner of the present invention is used.

As a result of the present inventors' investigation, it is discovered that by using a solution dispersion method in which a resin A, which does not dissolve in water but dissolves in basic water, is dissolved in a basic aqueous medium, and an oil phase liquid (i.e., a toner component liquid) is added to the basic aqueous medium to be dispersed therein, droplets of the oil phase liquid can be stably dispersed in the aqueous medium. The present invention is made based on the discovery.

In solution suspension methods in which droplets of an oil phase liquid are dispersed in an aqueous medium, a fine particulate resin is dispersed in the aqueous medium to stabilize the droplets of the oil phase liquid in the aqueous medium. The mechanism therefor is considered to be that the fine particulate resin included in the aqueous medium adheres to the surface of the droplets of the oil phase liquid, thereby stabilizing the droplets in the aqueous medium. In this regard, the smaller the fine particulate resin, the larger the total area of the surface of the droplets covered with the fine particulate resin, i.e., the smaller the particle diameter of the droplets.

In this regard, the amount of the fine particulate resin adsorbed on the surface of the droplets of the oil phase liquid changes depending on the zeta potential of the fine particulate resin, resulting in change of the particle diameter of the droplets. Therefore, when the zeta potential of the fine particulate resin used changes, the particle diameter and the surface conditions of the resultant toner considerably change, resulting in wide variation of the properties of the toner.

In addition, it is considered that the conditions of the dispersed droplets change depending on the position of the fine particulate resin at the interface between the droplets and the aqueous medium and the total area of the interface covered with the fine particulate resin. However, when the fine particulate resin is dissolved in the aqueous medium, it is not necessary to control the particle diameter and zeta potential of the resin.

As a result of the present inventors' investigation, it is discovered that by dissolving a basic material and a resin in an aqueous medium, and dispersing an oil phase liquid in the aqueous medium, droplets of the oil phase liquid can be stably dispersed while having a sharp particle diameter distribution.

Specifically, a resin A, which can dissolve in basic water (preferably basic water having a pH of not lower than 9), is added to a basic aqueous medium to prepare an aqueous medium in which the resin A is dissolved, and an oil phase liquid is added to the aqueous medium so that droplets of the oil phase liquid are stably dispersed in the aqueous medium by the resin A. This is one of the features of the present invention.

The mechanism of stabilization of droplets of an oil phase liquid in such an aqueous medium is not yet determined, but is considered as follows. Specifically, when an oil phase liquid is dispersed in an aqueous medium in which a resin A, which has a certain amount of carboxyl groups derived from acids such as acrylic acid and methacrylic acid, is dissolved using a basic material, part of the resin A cannot maintain the dissolved state because the pH of the system decreases due to the acid groups included in a binder resin having a polyester skeleton and included in the oil phase liquid, and the solvents included in the added oil phase liquid, part of which is dissolved in the aqueous medium, and thereby it becomes difficult for the electrolytes in the aqueous medium to cause dissociation. Therefore, the part of the resin A is deposited on the surface of droplets of the oil phase liquid so as to cover the surface, thereby stabilizing the droplets of the oil phase liquid.

The above-mentioned mechanism is completely different from that in conventional solution suspension methods (hereinafter sometimes referred to as particle emulsion methods) in which droplets of oil phase liquid is emulsified in an aqueous medium using a fine particulate resin. Therefore, even when the same resin as that used as a fine particulate resin for such conventional particle emulsion methods is used for the toner preparation method of the present invention, the properties of the resultant toner particles (such as average particle diameter and particle diameter distribution) are different from the toner particles prepared by using the conventional particle emulsion methods.

In addition, in such conventional particle emulsion methods, the average particle diameter of the resultant toner particles changes depending on the average particle diameter of the fine particulate resin used, even when the material constituting the fine particulate resin is not changed. By contrast, in the toner preparation method of the present invention, the resultant toner particles have the same properties independently of the average particle diameter of the fine particulate resin (i.e., resin A) because the resin A is dissolved in an aqueous medium. Therefore, even when a fine particulate resin, whose particle properties (such as average particle diameter and particle diameter distribution) largely change due to variation in manufacturing conditions, is used as the resin A in the toner preparation method of the present invention, the properties of the resultant toner particle hardly change because the fine particulate resin is dissolved in an aqueous medium.

Thus, by using the toner preparation method of the present invention, toner having constant properties can be produced. Therefore, when the toner is used for electrophotographic image forming apparatuses, in which the developing operation is performed while supplying a supplementary toner to the developing device, occurrence of problems such that image qualities are changed (for example, a background development problem in that the background of images is soiled with toner particles is caused) due to change of the properties of the supplementary toner can be prevented.

Next, the toner and toner preparation method of the present invention will be described in detail.

Suitable materials for use as the resin A to be dissolved in an aqueous medium including a basic material include any known resins, which have a solubility of less than 2.0 g/100 g in water having a pH of 3.0 at 25° C. while having a solubility of not less than 2.0 g/100 g in water having a pH of 10.0 at 25° C. Namely, the resin used as the resin A preferably has such a property that the resin is dissolved in an aqueous medium including a basic material and at least part of the resin is deposited when a toner component liquid (oil phase liquid) is added to the aqueous medium.

Next, the method for determining whether a resin is dissolved in an aqueous medium will be described.

In a dispersion, in which a resin is dispersed as particles in an aqueous medium (i.e., a resin is not dissolved in an aqueous medium), the dispersion looks opaque due to difference in refractive index between the resin and the aqueous medium. By contrast, when a resin is dissolved in an aqueous medium, the solution looks transparent because the solution is homogeneous. Therefore, whether a resin is dissolved in an aqueous medium is determined by measuring the transparency of the liquid using light having a wavelength of 600 nm.

Specifically, a resin dispersion is diluted with ion exchange water while controlling the pH thereof at 3.0 and the temperature thereof at 25° C. to prepare 100 ml of a diluted resin dispersion having a solid content of 2.0% by weight. In this regard, the pH adjustment is performed using a 0.5N aqueous solution of hydrochloric acid or a 0.5N aqueous solution of sodium hydroxide (in a case where the diluted resin dispersion has a pH lower than 3.0, a 0.5N aqueous solution of sodium hydroxide is used). After the liquid having a pH of 3.0 is agitated for 1 hour, 2 ml of the liquid is fed into a quartz cell of 1 cm square. After the liquid is allowed to settle for 1 minute, the transparency of the liquid at a wavelength of 600 nm is measured 25° C. using a spectrophotometer UV2550 from Shimadzu Corp. In this regard, the transparency (T) of the liquid is represented by the following equation.

$$T(\%)=(I/IO)\times 100$$

wherein IO represents the intensity of incident light, and I represents the intensity of transmitted light.

In this regard, ion exchange water is contained in the reference cell. When the sample liquid is colored by a colorant, the same colorant is added to ion exchange water in the reference cell so that the ion exchange water includes the colorant in the same amount.

When the transparency is not lower than 95%, it is judged that the resin is dissolved in the aqueous medium. Namely, the solubility of the resin in water having a pH of 3.0 is not less than 2.0 g/100 g. When the transparency is lower than 95%, the solubility of the resin in water having a pH of 3.0 is less than 2.0 g/100 g.

Similarly to the method for preparing the liquid having a pH of 3.0, 100 ml of a liquid having a pH of 10.0 and a solid content of 2.0% by weight is prepared using a 2N aqueous solution of sodium hydroxide. After the liquid having a pH of 10.0 is agitated for 1 hour, the transparency of the liquid is measure by the method mentioned above.

When the transparency is not lower than 95%, it is judged that the resin is dissolved in the aqueous medium. Namely, the solubility of the resin in water having a pH of 10.0 is not less than 2.0 g/100 g. When the transparency is lower than 95%, the solubility of the resin in water having a pH of 10.0 is less than 2.0 g/100 g.

The solid content of a dispersion is determined by a method including containing 2 g of the dispersion in an aluminum dish, heating the dispersion for 30 minutes at 150° C., and weighing the dried material (W) on the aluminum dish. The solid content is obtained by (W/2)×100 (% by weight).

When the resin is not a dispersion and is a solid, the solid resin is initially pulverized using a pulverizer such as OSTER BLENDER, followed by sieving using a screen with openings of 0.5 mm to obtain a powder of the resin having a particle size of less than 0.5 mm. Two (2) grams of the resin powder is fed into 98 g of ion exchange water, followed by agitating to prepare a resin dispersion. Since such a resin dispersion has a greater particle size than the above-mentioned resin dispersion, the time of the agitation operation performed after adjustment of the pH is changed from 1 hour to 3 hours, and in addition sampling of the pH-controlled liquid is performed while agitating the liquid. In addition, the pH-controlled liquid is visually observed to determine whether there is precipitate in the liquid. If there is precipitate in the liquid, it is judged that the resin is not dissolved in the medium.

More preferable materials for use as the resin A are resins having a unit obtained from a monomer having the below-mentioned formula (1) (hereinafter referred to as monomer 1) and another unit obtained from a monomer having the below-mentioned formula (2) (hereinafter referred to as monomer 2), wherein the added amount of the monomer 1 is from 20 to 80 parts by weight per 100 parts by weight of all the monomers used for preparing the resins, and the added amount of the monomer 2 is from 15 to 65 parts by weight.

(1)

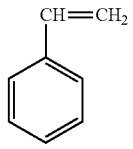

(2)

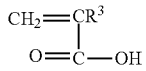

wherein $R^3$ represents a hydrogen atom or a methyl group.

The unit obtained from the monomer 1 enhances the lipophilic property of the resin A and imparts a charging ability to the toner. The added amount of the monomer 1 is from 20 to 80 parts by weight, preferably from 30 to 70 parts by weight, and more preferably from 40 to 60 parts by weight, per 100 parts by weight of all the monomers used for preparing the resin A. When the content of the unit obtained from the monomer 1 in the resin A is too low, the resultant toner has insufficient charging ability. By contrast, when the content of the unit obtained from the monomer 1 in the resin A is too high, it becomes difficult to dissolve the resin A in a basic aqueous medium and/or the resin A migrates into the oil phase liquid because the resin A has too strong a lipophilic property, thereby lessening the dispersion stability improving effect of the resin A.

The unit obtained from the monomer 2 imparts a proper solubilization-insolubilization changing property such that the resin A dissolved in an aqueous medium achieves a proper insoluble state in the mixture of the aqueous medium and an oil phase liquid, to the resin A when the content of the unit in the resin A falls in a proper range. The added amount of the monomer 2 is from 15 to 65 parts by weight, preferably from 20 to 50 parts by weight, and more preferably from 25 to 45 parts by weight, per 100 parts by weight of all the monomers used for preparing the resin A. When the content of the unit obtained from the monomer 2 in the resin A is too low, it becomes difficult to dissolve the resultant resin A in a basic aqueous medium or to stably disperse droplets of an oil phase liquid in the aqueous medium. By contrast, when the content of the unit obtained from the monomer 2 in the resin A is too high, change of the state of the resin A from a solubilization state to an insolubilization state cannot be satisfactorily performed and/or the insolubilized resin A cannot be adsorbed to droplets of an oil phase liquid, thereby forming unstable oil phase droplets.

In addition, when a unit obtained from a monomer having the below-mentioned formula (3) (hereinafter referred to as a monomer 3) is included in the resin A so that the resin A has a proper glass transition temperature, deterioration of the fixing property of the resultant toner due to the resin A (which covers the surface of toner particles) can be prevented.

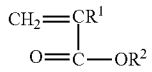

(3)

wherein $R^1$ represents a hydrogen atom or a methyl group, and $R^2$ represents a hydrocarbon group having 1 to 22 carbon atoms.

Specific examples of the monomer 3 include methyl acrylate, ethyl acrylate, n-propyl acrylate, iso-propyl acrylate, n-butyl acrylate, iso-butyl acrylate, tert-butyl acrylate, hexyl acrylate, octylacrylate, 2-ethylhexyl acrylate, nonylacrylate, decyl acrylate, lauryl acrylate, palmityl acrylate, myristyl acrylate, stearyl acrylate, behenyl acrylate, methyl methacrylate, ethyl methacrylate, n-propyl methacrylate, iso-propyl methacrylate, n-butyl methacrylate, iso-butyl methacrylate, tert-butyl methacrylate, hexyl methacrylate, octyl methacrylate, 2-ethylhexyl methacrylate, nonyl methacrylate, decylmethacrylate, laurylmethacrylate, palmityl methacrylate, myristyl methacrylate, stearyl methacrylate, behenyl methacrylate, etc.

Further, when the resin A includes a unit obtained from a monomer having the below-mentioned formula (4) (hereinafter referred to as a monomer 4), the charging ability of the resin A can be enhanced.

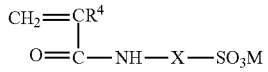

(4)

wherein $R^4$ represents a hydrogen atom or a methyl group, X represents a divalent hydrocarbon group, and M represents a hydrogen atom, a sodium atom, a potassium atom or a hydrocarbon group having 1 to 4 carbon atoms.

When the resin A is prepared, a monomer having plural polymerizable functional groups can also be used. In this regard, in order that the resultant resin A can be dissolved in a basic aqueous medium, the added amount of such a monomer is preferably less than 1% by weight based on the total weight of the monomers used for preparing the resin A. Specific examples of such a monomer include divinyl benzene, diacrylates or dimethacrylates of diol compounds (e.g., ethylene glycol, propylene glycol, 1,4-butanediol, 1,6-hexanediol, 1,8-octanediol, 1,9-nonanediol, bisphenol A, alkylene oxide adducts of bisphenol A, polyethylene glycol, and polypropylene glycol), glycerol triacrylate, pentaerythritol tetraacrylate, etc.

Next, the method for preparing the resin A will be described.

The resin A can be prepared by polymerizing a monomer composition including at least the monomers 1 and 2. Any polymerization methods including radical polymerization methods, anionic polymerization methods, and cationic polymerization methods can be used for polymerizing the resin A. Among the polymerization methods, radical polymerization methods are preferably used because of using a relatively simple device. Radical polymerization methods are broadly classified into bulk radical polymerization methods, in which a monomer composition is polymerized without using a solvent or a dispersing medium; solution radical polymerization methods, in which a monomer composition is polymerized in a solvent capable of dissolving the monomer composition and including a radical generating agent; suspension polymerization methods, in which a monomer composition including an oil-soluble radical generating agent is dispersed in an aqueous medium to be polymerized by the radical generating agent; and emulsion radical polymerization methods, in which a monomer composition is polymerized in an aqueous medium including a surfactant (i.e., emulsifier) and a water-soluble radical generating agent to be reacted by the radical generating agent. Among these radical polymerization methods, solution polymerization methods, suspension polymerization methods and emulsion polymerization methods are preferably used because heat generated by the polymerization reaction can be easily controlled. Further, the suspension polymerization methods and emulsion polymerization methods are more preferably used because the solvent can be easily removed after the polymerization reaction, and emulsion polymerization methods are even more preferably used because the reaction speed is the fastest among these polymerization methods.

When a resin A is prepared by an emulsion polymerization method or a suspension polymerization method, the resin A is obtained as an aqueous dispersion. The thus prepared resin A can be used for preparing the toner of the present invention regardless of the particle diameter properties such as average particle diameter and the particle diameter distribution thereof (e.g., ratio (Dv/Dn) of the volume average particle diameter Dv to the number average particle diameter Dn). In addition, it causes no problem to use two or more resin dispersions, which are prepared by using the same monomer composition but which have different particle diameter properties, as the resin A. Further, when the added amount of emulsifier used for emulsion polymerization of the resin A is from 0.02 to 2% by weight based on the weight of the resin A, the influence of the emulsifier on the toner preparation process is little. When the added amount of emulsifier is from 0.05 to 1% by weight based on the weight of the resin A, the emulsifier does not influence the toner preparation process. The reason why the influence of an emulsifier on the toner preparation process is little is that even though the emulsifier assists to stabilize droplets of an oil phase liquid in an aqueous medium in the toner preparation process, the added amount of the emulsifier is relatively small compared with those of the other secondary materials (e.g., the resin A, emulsifier newly added to the aqueous medium used for dispersing the oil phase liquid, and additives added for controlling the stability of droplets of the oil phase liquid in the aqueous medium).

Part or entire of the emulsifier used for emulsion-polymerizing the resin A can be replaced with an emulsifier having a polymerizable functional group (so called reactive emulsifiers). In addition, a basic material may be added to the resultant emulsion of the resin A to dissolve the resin, and to use the resultant aqueous solution for the toner preparation process.

The resin A generally has a weight average molecular weight of from 20,000 to 500,000, preferably from 50,000 to 200,000, and more preferably from 80,000 to 180,000. When the weight average molecular weight of the resin A is lower than 20,000, the dispersion stabilization effect thereof is lessened, thereby making it impossible to control the particle properties of the toner. By contrast, when the weight average molecular weight is higher than 500,000, it becomes difficult to dissolve the resin A in a basic aqueous medium.

Next, the toner components and the method for preparing the toner will be described.

The toner of the present invention includes a binder resin. Suitable materials for use as the binder resin include resins, which can be partially or entirely dissolved in an organic solvent and which have an acid value of from 2 to 24 mgKOH/g. When the acid value is greater than 24 mgKOH/g, the resin tends to migrates into the aqueous medium, thereby deteriorating the yield of the toner, or causing a problem in that the stability of droplets of the oil phase liquid deteriorates. By contrast, when the acid value is less than 2 mgKOH/g, the polarity of the resin tends to decrease, and thereby it becomes difficult to evenly disperse a colorant having a considerably high polarity in the oil phase liquid.

The kind of the resins for use as the binder resin of the toner is not particularly limited, but it is preferable to use a resin having a polyester skeleton for the binder resin because a good fixability can be imparted to the toner. Examples of the resin having a polyester skeleton include polyester resins, and block polymers having a polyester skeleton and another resin skeleton. Among these resins, polyester resins are preferably used because of being capable of producing an even colored particulate resin (i.e., toner particles).

Examples of the polyester resins include polyester resins obtained by ring-opening polymerization methods, polyester resins obtained by subjecting a hydroxycarboxylic acid to condensation polymerization, and polyester resins obtained by subjecting a polyol and a polycarboxylic acid to polycondensation. Among these polyester resins, polyester resins obtained by subjecting a polyol and a polycarboxylic acid to polycondensation are preferably used because of having great flexibility in designing formulation of toner.

It is preferable to use polyester resins, which have a peak molecular weight of from 1,000 to 30,000, preferably from 1,500 to 10,000, and more preferably from 2,000 to 8,000, as the binder resin. When the peak molecular weight is lower than 1,000, the high temperature preservability of the toner tends to deteriorate. By contrast, when the peak molecular weight is higher than 30,000, the low temperature fixability of the toner tends to deteriorate.

In addition, it is preferable to use polyester resins, which have a glass transition temperature of from 35 to 80° C., preferably from 40 to 70° C., and more preferably from 45 to 65° C. When the glass transition temperature is lower than 35° C., the resultant toner particles tend to deform or aggregate under high temperature conditions in summer, and thereby the toner particles cannot be used as toner. By contrast, when the glass transition temperature is higher than 80° C., the fixability of the toner particles deteriorates.

Suitable materials for use as the polyol (1) for preparing the polyester resin to be included in the toner include diols (1-1), polyols (1-2) having three or more hydroxyl groups. It is preferable to use diols (1-1) or mixtures of a diol (1-1) and a small amount of polyol (1-2).

Specific examples of the diols include alkylene glycols (e.g., ethylene glycol, 1,2-propylene glycol, 1,3-propylene glycol, 1,4-butane diol, and 1,6-hexane diol); alkylene ether glycols (e.g., diethylene glycol, triethylene glycol, dipropylene glycol, polyethylene glycol, polypropylene glycol, and polytetramethyleneether glycol); alicyclic diols such as 1,4-cyclohexane dimethanol and hydrogenated bisphenol A; bisphenol compounds such as bisphenol A, bisphenol F, bisphenol S; adducts of the above-mentioned alicyclic diols with an alkylene oxide (such as ethylene oxide, propylene oxide and butylene oxide); 4,4'-dihydroxybiphenyl compounds (e.g., 3,3'-difluoro-4,4'-dihydroxybiphenyl); bis(hydroxyphenyl)alkane compounds (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (i.e., tetrafluorobisphenol A), and 2,2-bis(3-hydroxyphenyl)-1,1,1,3,3,3-hexafluoropropane); bis(4-hydroxyphenyl) ether compounds (e.g., bis(3-fluoro-4-hydroxyphenyl)ether); adducts of the above-mentioned bisphenol compounds with an alkylene oxide (such as ethylene oxide, propylene oxide and butylene oxide); etc.

Among these compounds, alkylene glycols having 2 to 12 carbon atoms and alkylene oxide adducts of bisphenols are preferable. More preferably, alkylene oxide adducts of bisphenols, and mixtures of an alkylene oxide adduct of a bisphenol and an alkylene glycol having 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolac and cresol novolac); adducts of the polyphenols mentioned above with an alkylene oxide such as ethylene oxide, propylene oxide and butylene oxide; etc.

Suitable materials for use as the polycarboxylic acid (2) for use in preparing the polyester resin to be included in the toner include dicarboxylic acids (2-1) and polycarboxylic acids (2-2) having three or more carboxyl groups. It is preferable to use dicarboxylic acids (2-1) or mixtures of a dicarboxylic acid (2-1) and a small amount of polycarboxylic acid (2-2).

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid, naphthalene dicarboxylic acids, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl) hexafluoropropane, 2,2-bis(3-carboxyphenyl) hexafluoropropane, 2,2'-bis(trifluoromethyl)-4,4'-biphenyldicarboxylic acid, 2,2'-bis(trifluoromethyl)-3,3'-biphenyldicarboxylic acid, and hexafluoroisopropylidenediphthalic anhydride; etc. Among these compounds, alkenylene dicarboxylic acids having 4 to 20 carbon atoms and aromatic dicarboxylic acids having 8 to 20 carbon atoms are preferably used.

Specific examples of the polycarboxylic acids (2-2) having three or more hydroxyl groups include aromatic polycarboxylic acids having from 9 to 20 carbon atoms (e.g., trimellitic acid and pyromellitic acid), anhydrides and lower alkyl esters (e.g., methyl, ethyl and isopropyl esters) of the aromatic polycarboxylic acids, etc.

Suitable mixing ratio (i.e., the equivalence ratio [OH]/[COOH]) of the [OH] group of a polyol (1) to the [COOH] group of a polycarboxylic acid (2) is from 2/1 to 1/2, preferably from 1.5/1 to 1/1.5 and more preferably from 1.3/1 to 1/1.3.

When the colored particulate resin (i.e., toner particles) is prepared, a modified resin having an isocyanate group at the end thereof can be optionally dissolved in the oil phase liquid to enhance the mechanical strength and fixing property (such as hot offset resistance) of the toner particles. Specific examples of the method for preparing such a modified resin include methods in which a monomer composition including a monomer having an isocyanate group is polymerized; and methods in which a resin having an active hydrogen atom is prepared, and the resin is reacted with a polyisocyanate to incorporate an isocyanate at the end of the resin. Among these methods, the latter methods are preferably used. Specific examples of the group having an active hydrogen atom include hydroxyl groups (e.g., alcoholic hydroxyl groups and phenolic hydroxyl groups), amino groups, carboxyl groups, mercapto groups, etc. Among these groups, alcoholic hydroxyl groups are preferably used. In order to prepare toner particles having good uniformity, it is preferable for the modified resin to have the same skeleton (preferably polyester skeleton) as one or more resins dissolved in the oil phase liquid. In order to prepare a polyester resin having an alcoholic hydroxyl groups at the end thereof, methods in which a polyol and a polycarboxylic acid are subjected to polycondensation, wherein the added amount of the polyol is increased so that the number of hydroxyl groups of the polyol is greater than that of carboxyl groups of the polycarboxylic acid.

Part of the isocyanate group of the modified polyester resin is converted to amino groups in the particle preparation process in which the oil phase liquid including the modified polyester resin is dispersed in an aqueous medium to prepare a colored particulate resin, and the thus generated amino groups are reacted with residual isocyanate groups, thereby extending the polymer chain of the modified resin. The polymer chain growth of the modified resin can be performed by other reactions. Alternatively, in order to increase the number of crosslinking points, an amine compound can be used in combination with the modified resin. Specific examples of such an amine compound include diamines (B1), polyamines (B2) having three or more amino groups, amino alcohols (B3), amino mercaptan (B4), amino acids (B5), and blocked amines (B6) of the amines (B1-B5).

Specific examples of the diamines (B1) include aromatic diamines (e.g., phenylene diamine, diethyltoluene diamine and 4,4'-diaminodiphenyl methane, tetrafluoro-p-xylylene diamine, and tetrafluoro-p-phenylene diamine); alicyclicdiamines (e.g., 4,4'-diamino-3,3'-dimethyldicyclohexyl methane, diaminocyclohexane and isophoron diamine); aliphatic diamines (e.g., ethylene diamine, tetramethylene diamine, hexamethylene diamine, dodecafluorohexylene diamine, and tetracosafluorododecylene diamine); etc.

Specific examples of the polyamines (B2) having three or more amino groups include diethylene triamine, triethylene tetramine, etc.

Specific examples of the amino alcohols (B3) include ethanol amine, hydroxyethyl aniline, etc.

Specific examples of the amino mercaptans (B4) include aminoethyl mercaptan, aminopropyl mercaptan, etc.

Specific examples of the amino acids (B5) include aminopropionic acid, aminocaproic acid, etc.

Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc.

Among these amines, diamines (B1) and mixtures of a diamine (B1) and a small amount of polyamine (B2) are preferable.

The mixing ratio (i.e., the equivalence ratio [NHx]/[NCO]) of the [NHx] group of an amine (B) to the [NCO] group of a prepolymer (A) having an isocyanate group is not greater than 4, preferably not greater than 2, more preferably not greater than 1.5, and even more preferably not greater than 1.2. When the mixing ratio is greater than 4, excess of amino group blocks isocyanate groups, thereby stopping the polymer chain growth reaction (i.e., forming a polyester resin having a low molecular weight), resulting in deterioration of the hot offset resistance of the resultant toner.

The solvent used for dissolving or dispersing toner components is preferably a volatile solvent having a boiling point lower than 100° C. so as to be easily removed from the dispersion including the resultant toner particles. Specific examples of such volatile solvents include water-compatible or water-incompatible solvents such as toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, when the resin dissolved or dispersed in the solvent is a polyester resin, ester solvents such as methyl acetate, ethyl acetate and butyl acetate, and ketone solvents such as methyl ethyl ketone and methyl isobutyl ketone are preferably used because polyester resins can be well dissolved therein. Among these ester and ketone solvents, methyl acetate, ethyl acetate and methyl ethyl ketone are more preferable.

Suitable materials for use as the aqueous medium include water. In addition, organic solvents, which can be mixed with water, can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

In order to stabilize droplets of the oil phase liquid in the aqueous medium, the aqueous medium preferably includes a surfactant. Suitable materials for use as the surfactant include anionic surfactants, cationic surfactants, nonionic surfactants, and ampholytic surfactants.

Suitable anionic surfactants include alkylbenzene sulfonic acid salts, α-olefin sulfonic acid salts, and phosphoric acid salts.

Suitable cationic surfactants include amine salt based surfactants and quaternary ammonium salt based surfactants. Specific examples of the amine salt based surfactants include alkyl amine salts, aminoalcohol fatty acid derivatives, polyamine fatty acid derivatives, and imidazoline. Specific examples of the quaternary ammonium salt based surfactants include alkyltrimethyl ammonium salts, dialkyldimethyl ammonium salts, alkyldimethyl benzyl ammonium salts, pyridinium salts, alkyl isoquinolinium salts, and benzethonium chloride.

Suitable nonionic surfactants include fatty acid amide derivatives, and polyhydric alcohol derivatives.

Suitable ampholytic surfactants include alanine, dodecyldi(aminoethyl)glycin, di(octylaminoethyle)glycin, and N-alkyl-N,N-dimethylammonium betaine.

It is preferable to use a surfactant having a fluoroalkyl group because a good dispersing effect can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl (C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonylglycin, monoperfluoroalkyl(C6-C16)ethylphosphates, etc.

Specific examples of the cationic surfactants having a fluoroalkyl group include primary, secondary and tertiary aliphatic amino acids having a fluoroalkyl group, quaternary aliphatic ammonium salts having a fluoroalkyl group such as perfluoroalkyl(C6-C10)sulfoneamidepropyltrimethylammonium salts, benzalkonium salts having a fluoroalkyl group, benzetonium chloride having a fluoroalkyl group, pyridinium salts having a fluoroalkyl group, imidazolinium salts having a fluoroalkyl group, etc.

When the toner component liquid (i.e., oil phase liquid) is dispersed in the aqueous medium, an inorganic dispersant or a fine particulate resin can be included in the aqueous medium to prepare toner particles having a sharp particle diameter distribution. Specific examples of the inorganic dispersant include tricalcium phosphate, calcium carbonate, titanium oxide, colloidal silica, hydroxyapatite, etc.

The oil phase liquid can be satisfactorily dispersed in the aqueous medium using a polymer protection colloid.

Suitable polymer protection colloids include homopolymers and copolymers of acid monomers, (meth)acrylic monomers having a hydroxyl group, vinyl alcohol and ethers of vinyl alcohol, esters of vinyl alcohol and compounds having a carboxyl group, amides and methylol compounds thereof; acid chlorides, and monomers having a nitrogen atom or a heterocyclic ring including a nitrogen atom; polyoxyethylene resins; and cellulose compounds.

Specific examples of the acid monomers include acrylic acid, methacrylic acid, α-cyanoacrylic acid, α-cyanomethacrylic acid, itaconic acid, crotonic acid, fumaric acid, maleic acid, and maleic anhydride.

Specific examples of the acrylic monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide, and N-methylolmethacrylamide.

Specific examples of the ethers of vinyl alcohol include vinyl methyl ether, vinyl ethyl ether, and vinyl propyl ether.

Specific examples of the esters of vinyl alcohol with a compound having a carboxyl group include vinyl acetate, vinyl propionate, and vinyl butyrate.

Specific examples of the acrylic amides include acrylamide, methacrylamide, and diacetoneacrylamide.

Specific examples of the acid chlorides include acrylic acid chloride, and methacrylic acid chloride.

Specific examples of the monomers having a nitrogen atom or a heterocyclic ring having a nitrogen atom include vinyl pyridine, vinyl pyrrolidone, vinyl imidazole, and ethylene imine.

Specific examples of the polyoxyethylene resins include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters.

Specific examples of the cellulose compounds include methyl cellulose, hydroxyethyl cellulose, and hydroxypropyl cellulose.

When a compound such as calcium phosphate, which is soluble in an acid or alkali, is used as a dispersion stabilizer, the resultant toner particles are preferably mixed with an acid such as hydrochloric acid, followed by washing with water to remove calcium phosphate from the toner particles. In addition, calcium phosphate can be removed using a zymolytic method.

When a dispersant is used, the resultant toner particles are preferably washed after the prepolymer in the toner component liquid is subjected to a polymer chain growth reaction and/or a crosslinking reaction to impart good chargeability to the toner particles.

The colorant included in the toner component liquid (i.e., the colorant included in the toner particles) is not particularly limited, and any known dyes and pigments can be used therefor.

Specific examples of such dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials are used alone or in combination.

Master batches, which are complexes of a colorant with a resin, can also be used as the colorant of the toner.

Specific examples of the resins for use in the master batches include styrene polymers and substituted styrene polymers such as polystyrene, poly-p-chlorostyrene and polyvinyl toluene; copolymers of styrene (and substituted styrene) such styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate, styrene-acrylonitrile copolymers, styrene-vinyl methyl ketone copolymers, styrene butadiene copolymers, styrene-isoprene copolymers, styrene acrylonitrile-indene copolymers, styrene-maleic acid copolymers, and styrene-maleate copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic acid resins, rosin, modified rosins, terpene resins, aliphatic or alicyclic hydrocarbon resins, aromatic petroleum resins, chlorinated paraffin, paraffin waxes, etc. These resins can be used alone or in combination.

Such master batches can be prepared by mixing a resin and a colorant, and kneading the mixture while applying a high shearing force thereto. In this case, an organic solvent can be added to enhance the interaction between the colorant and the resin. In addition, a flushing method, in which an aqueous paste including a colorant and water is mixed with a resin dissolved in an organic solvent, the mixture is kneaded to transfer the colorant from the aqueous phase to the resin side (i.e., the oil phase), and then water and the organic solvent are removed from the kneaded mixture, can be preferably used because the resultant wet cake can be used without being dried. When performing the mixing and kneading process, dispersing devices capable of applying a high shearing force such as three roll mills can be preferably used.

The toner of the present invention can optionally include other components such as release agents, and charge controlling agents.

It is preferable to disperse a release agent in the toner component liquid to enhance the releasability of the resultant toner particles from fixing members in the fixing process.

Suitable materials for use as the release agent include materials such as waxes and silicone oils, which have a thermal property such that when heated, the materials have a low viscosity while being hardly mixed with the other toner components such as colorants and binder resins and the materials constituting the fixing members without swelling the materials constituting the fixing members. Among these materials, waxes are preferable because waxes are solid under normal preservation conditions of toner and have good preservation stability.

Specific examples of the waxes include long-chain hydrocarbons and waxes having a carbonyl group.

Specific examples of the long-chain hydrocarbons include polyolefin waxes (e.g., polyethylene waxes and polypropylene waxes); petroleum waxes (e.g., paraffin waxes, SAZOL waxes, microcrystalline waxes); Fischer Tropsch waxes; etc.

Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); and dialkyl ketones (e.g., distearyl ketone).

Among these release agents, long-chain hydrocarbons or mixtures of a long-chain hydrocarbon and a wax having a carbonyl group are preferable because of having good releasability. The content of the release agent in the toner particles is from 2 to 25% by weight, preferably from 3 to 20% by weight, and more preferably from 4 to 15% by weight, based on the toner particles. When the content is less than 2% by weight, the releasability improving effect can be hardly produced. By contrast, when the content is greater than 25% by weight, the mechanical strength of the toner particles tends to deteriorate.

The toner of the present invention can optionally include a charge controlling agent, i.e., a charge controlling agent can be dissolved or dispersed in the toner component liquid.

Any known charge controlling agents can be used for the toner.

Suitable examples of such charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, copper phthalocyanine, perylene, quinacridone, azo pigments, polymer compounds having a functional group such as sulfonate groups, carboxylate groups, and quaternary ammonium groups, etc. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.

The content of a charge controlling agent in the toner is generally from 0.5 to 5% by weight, and preferably from 0.8 to 3% by weight, based on the weight of the toner so that the charge controlling agent can produce the effect and does not deteriorate the properties (such as fixability) of the resultant toner.

Next, the method for preparing the toner of the present invention will be described.

Initially, an oil phase liquid (i.e., toner component liquid) in which toner components are dissolved or dispersed is prepared. Specifically, toner components including at least a resin and a colorant are gradually added to an organic solvent while agitated so that the toner components are dissolved or dispersed in the solvent. When a pigment is used as the colorant, and/or components such as release agents and charge controlling agents, which are hardly dissolved in organic solvents, are used, it is preferable to subject the pigment and components to a treatment before adding the components to an organic solvent so that the pigment and components have a relatively small average particle diameter. The method for forming a fine particulate toner component is not particularly limited, and for example the above-mentioned method for preparing the master batch of colorant can also be applied to such toner components (e.g., release agents and charge controlling agents).

Alternatively, a method in which a toner component is subjected to a dispersing treatment in an organic solvent optionally together with a dispersant to prepare a dispersion thereof can also be used for forming a fine toner component.

Further, a method in which a toner component is agitated in an organic solvent optionally together with a dispersant while heated to prepare a solution, and the solution is cooled to precipitate the component while agitated or applying a shear force thereto, thereby forming a dispersion of microcrystal of the component can also be used for forming a fine toner component.

The thus prepared dispersions of toner components such as colorants, release agents and charge controlling agents are mixed with a binder resin (or a binder resin solution or dispersion) in an organic solvent to be dissolved or dispersed, followed by an optional dispersing treatment using a dispersing machine such as bead mills and disc mills, resulting in formation of an oil phase liquid.

Next, the thus prepared oil phase liquid is granulized in an aqueous medium. Specifically, the oil phase liquid is dispersed in an aqueous medium, in which the resin A is dissolved using a basic material, using a dispersing method such as low speed shearing methods, high speed shearing methods, friction methods, high pressure jet methods and methods using ultrasonic wave. In order to prepare a dispersion having an average particle diameter of from 2 to 20 μm, the high speed shearing methods are preferably used. The temperature in the dispersing process is generally from 0 to 40° C., and preferably from 10 to 30° C. When the temperature is higher than 40° C., molecules of the toner components tend to be excited, thereby deteriorating the stability of the dispersion, resulting in formation of agglomerated particles or coarse particles of the toner components. By contrast, when the temperature is lower than 0° C., the viscosity of the dispersion tends to increase, and therefore it is necessary to increase the shearing energy, resulting in deterioration of the production efficiency.

Next, the organic solvent is removed from the thus prepared dispersion of a colored particulate resin. Specifically, the temperature of the dispersion is gradually raised while agitating the dispersion to remove the organic solvent from the oil phase liquid. Alternatively, a method in which the dispersion is agitated and sprayed in dry atmosphere to evaporate the organic solvent can also be used. Further, a method in which the dispersion is agitated under a reduced pressure to remove the organic solvent from the oil phase liquid can also be used. Each of the latter two methods can be used alone or in combination with the first-mentioned method.

In the second-mentioned method, specific examples of the dry atmosphere include gasses such as air, nitrogen gas, carbon dioxide gas, and combustion gas, which are preferably heated to a temperature higher than the boiling point of the organic solvent used for the oil phase liquid. Suitable driers for use in the method include spray driers, belt driers and rotary kilns, which can perform the drying treatment at a high speed.

When a modified resin having an isocyanate group at an end thereof is included in the oil phase liquid, an aging treatment can be optionally performed after the solvent removing process to proceed the polymer chain growth reaction and/or the crosslinking reaction of the modified resin. The aging time is generally from 10 minutes to 40 hours, and preferably from 2 hours to 24 hours, and the aging temperature is generally from 0 to 40° C., and preferably from 15 to 30° C.

Since the thus prepared dispersion of a colored particulate resin includes auxiliary agents such as dispersant (e.g., surfactants) as well as the colored particulate resin, the dispersion is preferably subjected to a washing treatment to remove the auxiliary agents therefrom. Specific examples of such washing methods include centrifugal methods, filtration methods under reduced pressure, filter press methods, etc., but are not limited thereto. In any case, a wet cake of the colored particulate resin can be obtained. When auxiliary agents cannot be sufficiently removed by one washing treatment, the obtained wet cake is dispersed again in water, and the resultant dispersion is further subjected to a washing treatment. The washing treatments can be repeated three or more times. When the filtration methods under reduced pressure or filter press methods are used for washing the colored particulate resin, a method in which an aqueous solvent is applied to the resultant cake on the filter to remove the auxiliary agents from the cake. Specific examples of the aqueous solvent applied to the resultant cake include water and mixture solvents of water with an alcohol such as methanol and ethanol, and water is preferable in view of cost.

Since the washed colored particulate resin includes a considerable amount of aqueous medium, the colored particulate resin is dried to remove the aqueous medium. Specific examples of the driers include spray drier, vacuum freeze driers, reduced-pressure driers, driers using static shelves on which the material to be dried is set, driers using moving shelves, fluidized bed driers, rotary driers, agitation driers, etc. It is preferable that the content of moisture in the dried colored particulate resin is less than 1% by weight. Since the dried colored particulate resin is generally aggregated slightly, it is preferable to dissociate the aggregated colored particulate using a machine such as jet mills, HENSCHEL MIXER, super mixer, coffee mills, OSTER BLENDER, food processors, etc.

Next, the image forming method and apparatus and process cartridge using the toner of the present invention will be described.

The image forming method and apparatus of the present invention form images by performing the above-mentioned charging, irradiating, developing, transferring and fixing processes.

Although the toner of the present invention can be used as a one component developer or for a two component developer in combination with a carrier, the toner is preferably used as a one component developer. In addition, the image forming apparatus preferably uses an endless intermediate transfer medium, which receives a toner image from an image bearing member and transfers the toner image to a recording material. Further, the image forming apparatus preferably includes one or more cleaners for cleaning the surfaces of the image bearing member and intermediate transfer medium to remove residual toner particles therefrom. The cleaners may use a cleaning blade. Furthermore, the image forming apparatus preferably uses a fixing device using a fixing member such as a roller and a belt, which is heated by a heater. In the regard, it is preferable not to apply an oil to the fixing member. Furthermore, the image forming apparatus can optionally include other devices such as a discharger for discharging the image bearing member after the image transfer process, a recycling device for feeding the toner particles collected by the cleaners to the developing device to reuse the toner particles, and a controller for controlling the operations of the above-mentioned devices of the image forming apparatus.

Figure 2:
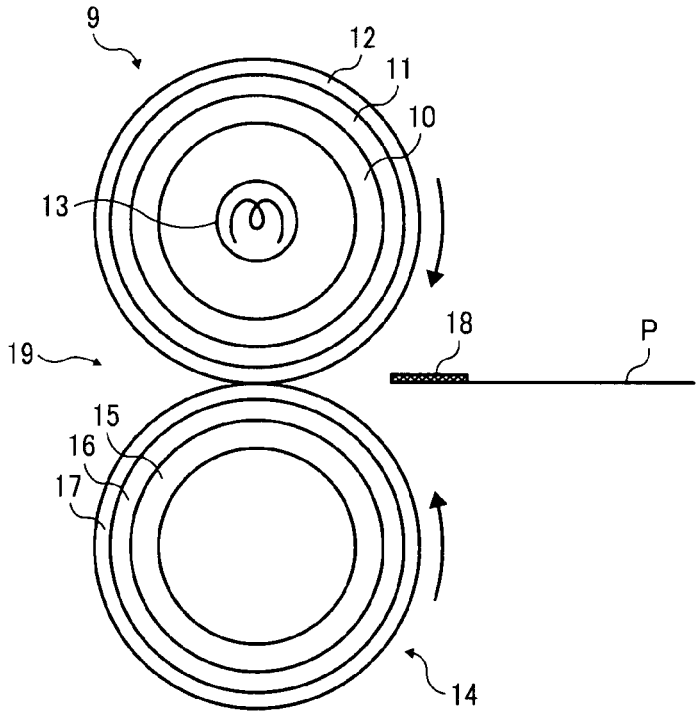
FIG. 2 is a schematic view illustrating a fixing device for use in the image forming apparatus illustrated in FIG. 1.

FIG. 1 illustrates an example of the image forming apparatus of the present invention, and FIG. 2 illustrates the fixing device of the image forming apparatus.

Referring to FIG. 1, the image forming apparatus includes an image bearing member 1, and a charger 2, an irradiating device 3, a developing device 4 containing a developer including a toner T, which is the toner of the present invention, a cleaner 5, an intermediate transfer medium 6, support rollers 7, and a transfer roller 8, which are provided in the vicinity of the image bearing member. The image forming apparatus optionally includes a toner supplying device 43 including a toner container 44 and a pump 45 to feed the toner to the developing device 4.

This image forming apparatus has a recording material cassette (not shown) containing recording sheets P serving as a recording material, and the recording sheets P are fed one by one by a feed roller (not shown). The thus fed recording sheet P is timely fed to a secondary transfer nip between the transfer roller 8 and the intermediate transfer medium 6 by a pair of registration rollers (not shown in FIG. 1).

The image forming method of the image forming apparatus is as follows. The charger 2 evenly charges a surface of the image bearing member 1, which is rotated clockwise, and the irradiating device 3 irradiates the charged image bearing member with laser light modulated based on image data to form an electrostatic latent image on the image bearing member. The developing device 4 develops the electrostatic latent image with the toner T of the present invention to form a toner image on the image bearing member 1. The toner image on the image bearing member 1 is transferred onto the intermediate transfer medium 6 to which a transfer bias is applied, and the toner image is then transferred onto the recording sheet P at the secondary transfer nip between the transfer roller 8 and the intermediate transfer medium. The recording sheet P bearing the toner image thereon is then fed to a fixing device 19 illustrated in FIG. 2 to fix the toner image. As illustrated in FIG. 2, the fixing device 19 has a fixing roller 9 heated to a predetermined temperature by a heater 13 set therein, and a pressure roller 14 pressed toward the fixing roller at a predetermined pressure. The recording sheet P bearing a toner image 18 is heated and pressed by the fixing roller 9 and the pressure roller 14, resulting in fixation of the toner image on the recording sheet. The recording sheet P bearing the fixed toner image thereon is then discharged from the main body of the image forming apparatus.

After the toner image is transferred from the image bearing member 1 to the intermediate transfer medium 6, the cleaner 5 removes toner particles remaining on the image bearing member and the discharger discharges residual charges on the image bearing member so that the image bearing member is ready for the charging operation of the next image forming operation.

Next, the devices and members of the image forming apparatus will be described.

The material, shape, configuration and size of the image bearing member 1 are not particularly limited. Specific examples of the shape include drum shapes, belt shapes, etc. Specific examples of the materials for use in the image bearing member include inorganic photoreceptors such as amorphous silicon and selenium, organic photoreceptors such as polysilane, phthalopolymethine, etc. Among these photoreceptors, amorphous silicon and organic photoreceptors are preferably used for the image bearing member 1.

In order to form an electrostatic latent image on the image bearing member 1, a method in which the image bearing member is charged and then irradiated with imagewise light using an electrostatic latent image forming device can be used. Specific examples of the electrostatic latent image forming device include a combination of the charger 2 and the irradiating device 3.

The charging operation is performed, for example, by the charger 2, which applies a voltage to the image bearing member 1. Specific examples thereof include contact chargers having a roller, brush, film or rubber blade, which is made of a semi-conductive material, and non-contact chargers utilizing corona discharging such as corotrons and scorotrons, but are not limited thereto.

As mentioned above, the shape of the charger is not limited to roller shapes, and brushes such as magnetic brushes and fur brushes can also be used therefor. Specific examples of the magnetic brushes include combinations of a charging member made of a particulate ferrite material such as Zn—Cu ferrites, a non-magnetic electroconductive sleeve supporting the charging member, and a magnet roller located in the sleeve to bear the charging member on the sleeve. Specific examples of the fur brushes include brushes having a shaft made of a metal or a material subjected to an electroconductive treatment, and fibers which are subjected to an electroconductive treatment using carbon, copper sulfide, a metal or a metal oxide and which are held by the shaft.

Among the contact and non-contact chargers, contact chargers are preferably used for the image forming apparatus because of generating a smaller amount of ozone in the charging operation than non-contact chargers.

The irradiation process is performed by irradiating the charged image bearing member with imagewise light using the irradiating device 3. The irradiating device is not particularly limited as long as the device can irradiate the charged image bearing member with imagewise light. Specific examples thereof include optical systems for use in copiers, rod lens arrays, laser optical systems, liquid shutter optical systems, etc.

The developing process is performed by developing an electrostatic latent image with the toner of the present invention using the developing device 4. The developing device is not particularly limited as long as the device can develop an electrostatic latent image with the toner of the present invention. Specific examples thereof include developing devices which supply the toner of the present invention to an electrostatic latent image in a contact or non-contact manner.

The developing device 4 preferably has a developing roller 40 which rotates while being contacted with the image bearing member 1 and which supplies the toner to an electrostatic latent image on the image bearing member to develop the electrostatic latent image, a toner layer forming member 41 to form a thin layer of the toner on the surface of the developing roller, and a supply roller 42 to supply the toner to the developing roller, as illustrated in FIG. 1. As mentioned above, the toner T is supplied from the toner container 44 to the developing device 4 by the pump 45.

Suitable rollers for use as the developing roller 40 include metal rollers and elastic rollers. Specific examples of the metal rollers include aluminum rollers, but are not limited thereto. The surface of the metal rollers may be subjected to a blast treatment to have a desired friction coefficient. Specifically, aluminum rollers whose surface is subjected to a blast treatment using glass beads so that the surface has a rough surface such that the thin toner layer can be satisfactorily formed thereon.

Suitable elastic rollers for use as the developing roller 40 include rollers in which an elastic rubber layer is formed on an electroconductive shaft (e.g., metal shaft such as SUS shafts) and an outermost layer made of a material having such a charging property as to have a charge with a polarity opposite to that of the toner is formed on the elastic rubber layer. The elastic rubber layer preferably has a JIS-A hardness of not higher than 60° to prevent occurrence of a problem in that a pressure is concentrated on the nip between the developing roller 40 and the toner layer forming member 41, thereby deteriorating the properties of the toner. The elastic rubber layer preferably has a Arithmetical Mean Deviation of the Profile (Ra) of from 0.3 to 2.0 μm so that a proper amount of toner is born by the surface of the developing roller 40. Since a development bias is applied to the developing roller 40 to form an electric field between the developing roller and the image bearing member 1, the elastic rubber layer preferably has an electric resistance of from $10^3$ to $10^1\Omega$. The developing roller 40 rotates counterclockwise in FIG. 1 to feed the toner to the nip between the toner layer forming member 41 and the developing roller and to the other nip between the developing roller and the image bearing member 1.

The toner layer forming member 41 is provided at a position higher in level than the contact point of the supply roller 42 and the developing roller 40. The toner layer forming member 41 is typically made of a metal such as stainless steel (SUS) and phosphor bronze, and a force of from 10 to 40N/m is applied to a free end of the member so as to be pressed toward the developing roller 40. Therefore, toner particles passing the nip between the toner layer forming member 41 and the developing roller 40 is frictionally charged while forming a layer on the developing roller. In addition, in order to assist frictional charging of the toner, a bias having the same polarity as that of the toner is applied to the toner layer forming member 41 so that the toner has a larger amount of charge.

Specific examples of the material for use in the elastic rubber layer include styrene-butadiene rubbers, acrylonitrile-butadiene rubbers, acrylic rubbers, epichlorohydrin rubbers, urethane rubbers, silicone rubbers, mixtures of two or more of these rubbers, etc., but are not limited thereto. Among these rubbers, epichlorohydrin rubbers, and acrylonitrile-butadiene rubbers are preferably used.

The transfer process is performed using a transfer roller while charging the image bearing member 1. A transfer roller is used for a primary transfer member to transfer a toner image from the image bearing member 1 to the intermediate transfer medium 6, and for a secondary transfer member (i.e., the roller 8) to transfer a toner image from the intermediate transfer medium to the recording sheet P. It is possible that plural color toners formed on the image bearing member 1 (or plural image bearing members) are transferred to the intermediate transfer medium 6 using one or more primary transfer members to form a combined color toner image on the intermediate transfer medium, and the combined color toner image is then transferred onto the recording sheet P using the secondary transfer member 8.

The intermediate transfer medium 6 is not particularly limited, and any known intermediate media such as intermediate transfer belts can be used.

Each of the primary and secondary transfer members preferably has at least one transfer member to subject a toner image to release charging. Specific examples thereof include corona chargers, transfer belts, transfer rollers, pressure rollers, and adhesive transfer rollers, etc.

Specific examples of the recording sheet P include paper sheets, plastic sheets (such a polyethylene terephthalate (PET) films), etc.

The fixing process is performed by fixing a toner image on the recording sheet P using a fixing device such as the heat fixing device 19. When plural color toner images are overlaid on the recording sheet P, the fixing process may be performed on each toner image or the overlaid plural color toner images.

Any known fixing device can be used for the fixing device of the image forming apparatus, and fixing devices which fix a toner image upon application of heat and pressure are preferably used. Specific examples of the heat/pressure fixing devices include fixing devices using a heat roller serving a fixing member, and a pressure roller as illustrated in FIG. 2, and fixing devices using a heat roller, a pressure roller, and an endless belt serving as a fixing member and heated by the heat roller. The temperature of the fixing member is preferably from 80 to 200° C.

An example of the heat/pressure fixing devices is illustrated in FIG. 2. The fixing device has a soft roller having an outermost layer made of a fluorine-containing material. Referring to FIG. 2, the heat roller 9 has a structure such that an elastic layer 11 made of a silicone rubber is formed on an aluminum shaft 10, and an outermost layer 12 made of a tetrafluoroethylene-perfluoroalkylvinyl ether copolymer (PFA) is formed on the elastic layer, and the heater 13 is provided in the heat roller. The pressure roller 14 has a structure such that an elastic layer 16 made of a silicone rubber is formed on an aluminum shaft 15, and an outermost layer 17 made of a PFA is formed on the elastic layer. The recording sheet P bearing the toner image 18 is fed to the fixing nip between the heat roller 9 and the pressure roller 14 in such a manner as illustrated in FIG. 2.

A photo fixing device can be used alone or in combination with another fixing method for the image forming apparatus of the present invention.

The discharging process is performed, for example, by applying a discharge bias to the image bearing member 1 or irradiating the image bearing member with light. Any known dischargers can be used for the discharging process, and discharging lamps are preferably used.

The cleaning process is performed by removing residual toner particles from the surface of the image bearing member 1 using a cleaner. Specific examples of the cleaner include magnetic brush cleaners, electrostatic brush cleaners, magnetic roller cleaners, blade cleaners, brush cleaners, web cleaners, etc.

The toner recycling process is performed by feeding the toner particles collected by the cleaning device 5 to the developing device 4 using a recycling device to reuse the toner particles for development. Specific examples of the recycling device include known powder feeding devices.

The controlling process is performed by controlling the operations of the above-mentioned devices and members using a controller. The controller is not particularly limited, and devices such as sequencers and computers can be used therefore.

By using the toner of the present invention for the image forming method and apparatus, and the below-mentioned process cartridge of the present invention, high quality images can be produced without causing a problem in that toner particles are damaged (broken) by the stresses applied to the toner in the developing device.

The image forming apparatus of the present invention can be applied to multi-color image forming apparatuses as well as monochrome image forming apparatuses.

Figure 3:
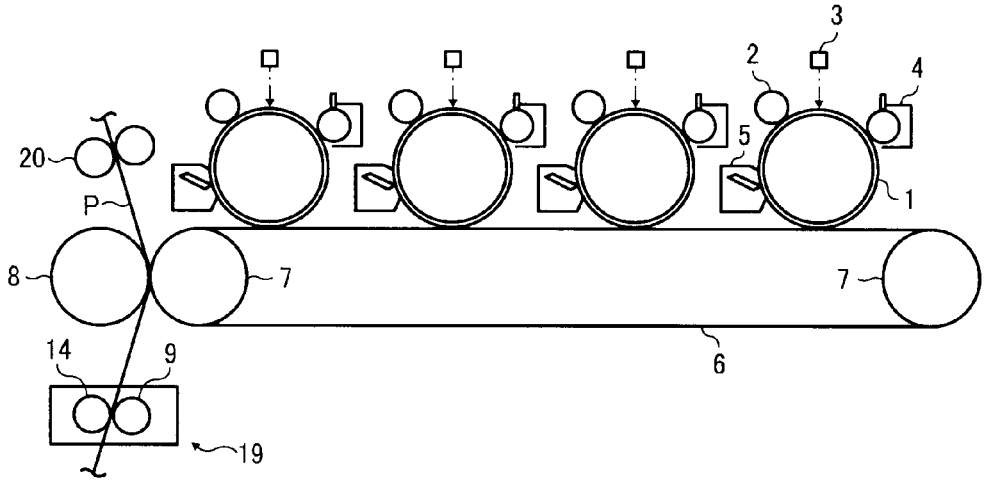
FIG. 3 is a schematic view illustrating the main portion of another example of the image forming apparatus of the present invention.

FIG. 3 illustrates a tandem full color image forming apparatus, which is an example of the image forming apparatus of the present invention.

Referring to FIG. 3, the full color image forming apparatus has four image forming units, each of which includes the image bearing member 1 rotated clockwise, and the charger 2, irradiating device 3, developing device 4 and cleaner 5, which are provided in the vicinity of the image bearing member. In addition, the image forming apparatus includes the intermediate transfer medium 6, which are supported by the support rollers 7, and transfer roller 8. The image forming apparatus further includes a sheet cassette (not shown) for containing plural recording sheets P, a feeding roller for feeding the recording sheet P, and a pair of registration rollers 20 for timely feeding the recording sheet to the secondary transfer nip formed by the transfer roller 8 and the intermediate transfer medium 6. Furthermore, the image forming apparatus has the fixing device 19 having the heat roller 9 and the pressure roller 14.

Next, the full color image forming method of the image forming apparatus illustrated in FIG. 3 will be described.

Referring to FIG. 3, in each image forming unit, the charger 2 charges the image bearing member 1, which is clockwise rotated, and the irradiating device 3 irradiates the charged image bearing member with laser light based on image data to form an electrostatic latent image on the image bearing member. The developing device develops the electrostatic latent image with a developer including a color toner (i.e., a yellow, magenta, cyan or black toner). Thus, four different color toner images are formed on the image bearing members are transferred one by one onto the intermediate transfer medium 6, resulting in formation of a combined color toner image on the intermediate transfer medium. The combined color toner image is transferred onto the recording sheet P at the secondary transfer nip, and the recording sheet is then fed to the fixing device 19, resulting in fixation of the combined color toner image. Thus, a full color image is formed.

Figure 4:
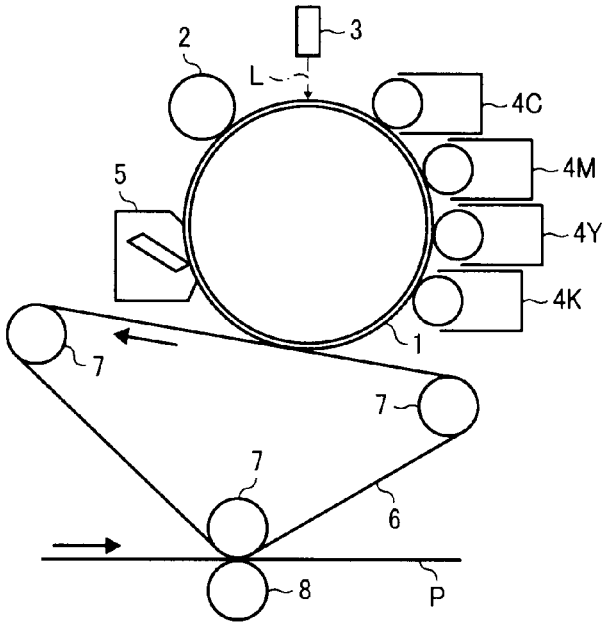
FIG. 4 is a schematic view illustrating the main portion of yet another example of the image forming apparatus of the present invention.

FIG. 4 illustrates another full color image forming apparatus (revolver type full color image forming apparatus), which is another example of the image forming apparatus of the present invention.

This image forming apparatus has one image bearing member 1 and four developing devices 4C, 4M, 4Y and 4K, and by switching the developing devices, cyan, magenta, yellow and black color toner images are sequentially formed on the image bearing member. The color toner images are then transferred one by one onto the intermediate transfer medium 6 rotated and supported by the support rollers 7, resulting in formation of a combined color toner image on the intermediate transfer medium. The thus formed combined color toner image is then transferred onto the recording sheet P at the secondary transfer nip formed by the transfer roller 8 and the intermediate transfer medium, followed by fixation thereon at a fixing device (not shown), resulting in formation of a full color image.

After transferring a first color toner image, the surface of the image bearing member is cleaned by a blade of the cleaner 5, followed by a discharging process in which residual charges are removed from the image bearing member 1. The thus discharged image bearing member 1 is then charged by the charger 2 to perform a second color toner image forming operation. The cleaner is not limited to a blade and a fur brush or the like can also be used.

Since the above-mentioned toner of the present invention is used for the color toners, high quality images can be produced by the image forming method and apparatus of the present invention.

The process cartridge of the present invention includes at least an image bearing member for bearing an electrostatic latent image thereon, and a developing device for developing the electrostatic latent image with a developer including the toner of the present invention to form a toner image on the image bearing member, and optionally includes other devices such as chargers, irradiating devices, transferring devices, cleaners, and discharging devices. The process cartridge is detachably attachable to an image forming apparatus as a unit using a guide member (such as rails) of the image forming apparatus.

The developing device includes at least a developer containing portion for containing the toner of the present invention or a developer including the toner of the present invention, and a developer bearing member for bearing the toner or developer thereon to feed the toner or developer to the developing area in which the developer bearing member faces the image bearing member. The developing device optionally includes a toner layer forming member for forming a toner layer on the developer bearing member. The process cartridge of the present invention is detachably attachable to image forming apparatus such as electrophotographic image forming apparatuses (e.g., copiers, facsimiles and printers. It is preferable to detachably attach the process cartridge to the image forming apparatus of the present invention.

Figure 5:
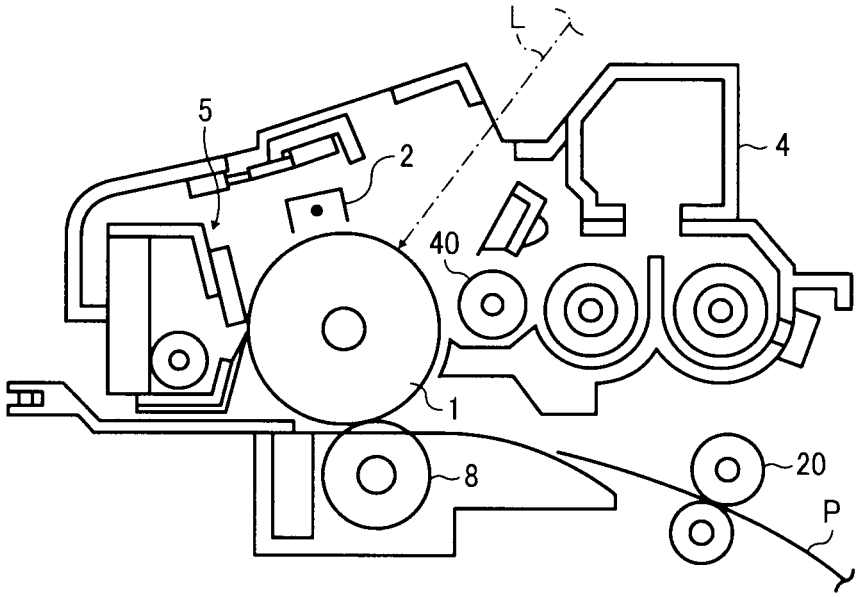
FIG. 5 is a schematic view illustrating a process cartridge, for which the toner of the present invention is used.

FIG. 5 illustrates an example of the process cartridge of the present invention.

Referring to FIG. 5, the process cartridge has the image bearing member 1, charger 2, developing device 4 bearing the developer bearing member 40, transfer roller 8, and cleaner 5. The process cartridge can optionally have other devices. In FIG. 5, reference character L and P respectively denote light emitted by an irradiating device to form an electrostatic latent image on the image bearing member 1, and the recording sheet. Since the configuration and operation of the image bearing member 1, charger 2, developing device 4, transfer roller 8, and cleaner 5 of the process cartridge are the same as those mentioned above for use in the image forming apparatus of the present invention, description of the devices and the image forming method thereof is omitted here.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Hereinafter, examples of the toner of the present invention, which is used as a one component developer will be described, but the toner can also be used in combination with a carrier so as to be used as a two component developer.

Initially, the methods for evaluating properties of toners of Examples and Comparative Examples mentioned below will be described.

1. Particle Diameter of Colored Particulate Resin (i.e., Toner Particles)

In the present application, the volume average particle diameter (Dv) of a toner is determined by an instrument such as COULTER COUNTER TA-II, MULTISIZER II, and MULTISIZER III, all of which are manufactured by Beckman Coulter, Inc. The measurement method is as follows:

(1) A surfactant serving as a dispersant, preferably 0.1 to 5 ml of a 1% aqueous solution of an alkylbenzenesulfonic acid salt, is added to 100 to 150 ml of an electrolyte such as 1% aqueous solution of first class NaCl or ISOTON-II manufactured by Beckman Coulter, Inc.;

(2) Two (2) to 20 mg of a sample (i.e., a toner) to be measured is added into the mixture;

(3) The mixture is subjected to an ultrasonic dispersion treatment for about 1 to 3 minutes; and (4) The volume-basis particle diameter distribution and number-basis particle diameter distribution of the toner are measured using the instrument mentioned above and an aperture of 100 μm.

The volume average particle diameter and number average particle diameter of the toner can be determined from the thus obtained volume- and number-basis particle diameter distributions.

In this case, the particle diameter channels are following 13 channels:

2.00 μm≦C1<2.52 μm; 2.52 μm≦C2<3.17 μm;
3.17 μm≦C3<4.00 μm; 4.00 μm≦C4<5.04 μm;
5.04 μm≦C5<6.35 μm; 6.35 μm≦C6<8.00 μm;
8.00 μm≦C7<10.08 μm; 10.08 μm≦C8<12.70 μm;
12.70 μm≦C9<16.00 μm; 16.00 μm≦C10<20.20 μm;

20.20 μm≦C11<25.40 μm; 25.40 μm≦C12<32.00 μm; and 32.00 μm≦C13<40.30 μm.

Thus, particles having a particle diameter not less than 2.00 μm and less than 40.30 μm are targeted.

2. Particle Diameter of Fine Particulate Resin (i.e., Resin A)

The average particle diameter of a resin A for use in an aqueous medium is measured with an instrument, UPA-150EX from Nikkiso Co., Ltd. The measuring conditions are as follows.

Transparency of particle: Transparent
Refractive Index of particle: 1.59
Shape of particle: Spherical
Solvent used: Water
Monodisperse: Nullity
Concentration of sample: Adjusted such that loading index falls in a range of from 1 to 1.5.

3. Molecular Weight

The molecular weight of a resin A is determined by gel permeation chromatography. The measuring conditions are as follows.

Instrument used: GPC-150C from Waters Corporation
Column used: KF801-807 from Showa Denko K.K.
Temperature of column: 40° C.
Solvent used: Tetrahydrofuran (THF)
Flow rate: 1.0 ml/min
Sample: A 0.05 to 0.6% by weight THF solution of a sample in an amount of 0.1 ml is injected.

The number average molecular weight and weight average molecular weight of the sample are determined on the basis of the thus determined molecular weight distribution of the sample and a molecular weight correction curve previously prepared using monodisperse polystyrenes. The monodisperse polystyrenes used are S-7300, S-210, S-390, S-875, S-1980, S-10.9, S-629, S-3.0, and S-0.580, which are from Showa Denko K.K. The solvent used for dissolving the polystyrenes is toluene. The detector used is a refractive index detector.

4. Glass Transition Temperature (Tg)

The glass transition temperature (Tg) of a resin is measured with a TG-DSC System TAS-100 from Rigaku Corporation. The method is as follows.

(1) About 5 mg of a sample, which is contained in an aluminum container, is set on a holder unit, and the holder unit is set in an electric furnace;

(2) The sample is heated from room temperature to 150° C. at a temperature rising speed of 10° C./min, followed by heating at 150° C. for 10 minutes and cooling to room temperature; and (3) After the sample is allowed to settle at room temperature for 10 minutes, the sample is heated again from room temperature to 150° C. at a temperature rising speed of 10° C./min in a nitrogen atmosphere to obtain a DSC curve of the sample.

The glass transition temperature (Tg) of the sample is determined using an analyzing system of TAS-100. The glass transition temperature is defined as the temperature at which the tangent line of the endothermic curve crosses the base line.

Next, the methods for preparing toner components used for Examples and Comparative Examples will be described.

1. Preparation of Polyester 1

The following components were contained in a reaction vessel equipped with a condenser, an agitator and a nitrogen feed pipe to perform a polycondensation reaction for 8 hours at 230° C. under normal pressure.

| | |
|---|---|
| Ethylene oxide adduct (2 mole) of bisphenol A | 229 parts |
| Propylene oxide adduct (2 mole) of bisphenol A | 529 parts |
| Terephthalic acid | 208 parts |
| Adipic acid | 46 parts |
| Dibutyl tin oxide | 2 parts |

The reaction was further continued for 5 hours under a reduced pressure of from 10 mmHg to 15 mmHg (1.33 Pa to 2.00 Pa). Next, 44 parts of trimellitic anhydride was added thereto and the mixture was reacted for 2 hours at 180° C. under normal pressure. Thus, a polyester resin 1 was prepared.

It was confirmed that the polyester resin 1 has a number average molecular weight (Mn) of 2,500, a weight average molecular weight (Mw) of 6,700, a glass transition temperature (Tg) of 43° C., and an acid value of 25 mgKOH/g.

2. Preparation of Polyester 2

The following components were contained in a reaction vessel equipped with a condenser, an agitator and a nitrogen feed pipe to perform a polycondensation reaction for 9 hours at 230° C. under normal pressure.

| | |
|---|---|
| Ethylene oxide adduct (2 mole) of bisphenol A | 270 parts |
| Propylene oxide adduct (2 mole) of bisphenol A | 497 parts |
| Terephthalic acid | 110 parts |
| Isophthalic acid | 102 parts |
| Adipic acid | 44 parts |
| Dibutyl tin oxide | 2 parts |

The reaction was further continued for 7 hours under a reduced pressure of from 10 mmHg to 18 mmHg (1.33 Pa to 2.39 Pa). Next, 40 parts of trimellitic anhydride was added thereto and the mixture was reacted for 2 hours at 180° C. under normal pressure. Thus, a polyester resin 2 was prepared.

It was confirmed that the polyester resin 2 has a number average molecular weight (Mn) of 3,000, a weight average molecular weight (Mw) of 8,600, a glass transition temperature (Tg) of 49° C., and an acid value of 22 mgKOH/g.

3. Preparation of Polyester 3

The following components were contained in a reaction vessel equipped with a condenser, an agitator and a nitrogen feed pipe to perform a polycondensation reaction for 8 hours at 230° C. under normal pressure.

| | |
|---|---|
| Ethylene oxide adduct (2 mole) of bisphenol A | 218 parts |
| Propylene oxide adduct (2 mole) of bisphenol A | 460 parts |
| Terephthalic acid | 140 parts |
| Isophthalic acid | 145 parts |
| Adipic acid | 44 parts |
| Dibutyl tin oxide | 2 parts |

The reaction was further continued for 6 hours under a reduced pressure of from 10 mmHg to 18 mmHg (1.33 Pa to 2.39 Pa). Next, 24 parts of trimellitic anhydride was added thereto and the mixture was reacted for 2 hours at 180° C. under normal pressure. Thus, a polyester resin 3 was prepared.

It was confirmed that the polyester resin 3 has a number average molecular weight (Mn) of 7,600, a weight average molecular weight (Mw) of 21,000, a glass transition temperature (Tg) of 57° C., and an acid value of 15 mgKOH/g.

4. Preparation of particulate vinyl resin dispersion 1 for use as resin A

The following components were fed into a reaction vessel equipped with a condenser, an agitator and a nitrogen feed pipe.

| | |
|---|---|
| Sodium dodecylsulfate | 1.4 parts |
| Ion exchange water | 498 parts |

The mixture was heated to 80° C. while agitated to prepare a solution. A potassium persulfate solution which had been prepared by dissolving 2.8 parts of potassium persulfate in 110 parts of ion exchange water was added to the solution.

After 15 minutes passed, a monomer mixture of the below-mentioned components was dropped into the mixture over 90 minutes.

| | |
|---|---|
| Styrene monomer | 140 parts |
| Methacrylic acid | 60 parts |
| n-Octanethiol | 0.3 parts |

The mixture was further heated for 60 minutes at 80° C. to perform a polymerization reaction, followed by cooling.

Thus, a bluish white dispersion of a particulate vinyl resin (hereinafter referred to as a particulate vinyl resin dispersion 1) was prepared.

It was confirmed that the particulate vinyl resin 1 has a volume average particle diameter (Dv) of 40 nm, and the ratio (Dv/Dn) of the volume average particle diameter (Dv) to the number average particle diameter (Dn) thereof is 1.14. In addition, 2 ml of the dispersion 1 was heated on a petri dish to obtain a solid of the vinyl resin, and the number average molecular weight and weight average molecular weight of the resin were measured. As a result, it was confirmed that the number average molecular weight and weight average molecular weight of the resin are 59,200 and 136,000, respectively.

5. Preparation of Particulate Vinyl Resin Dispersion 2 for Use as Resin A

The following components were fed into a reaction vessel equipped with a condenser, an agitator and a nitrogen feed pipe.

| | |
|---|---|
| Sodium dodecylsulfate | 0.7 parts |
| Ion exchange water | 498 parts |

The mixture was heated to 80° C. while agitated to prepare a solution. A potassium persulfate solution, which had been prepared by dissolving 2.8 parts of potassium persulfate in 110 parts of ion exchange water, was added to the solution.

After 15 minutes passed, a monomer mixture of the below-mentioned components was dropped into the mixture over 90 minutes.

| | |
|---|---|
| Styrene monomer | 140 parts |
| Methacrylic acid | 60 parts |
| n-Octanethiol | 0.3 parts |

The mixture was further heated for 60 minutes at 80° C. to perform a polymerization reaction, followed by cooling.

Thus, a white dispersion of a particulate vinyl resin 2 was prepared.

It was confirmed that the particulate vinyl resin 2 has a volume average particle diameter (Dv) of 92 nm, and the ratio (Dv/Dn) of the volume average particle diameter (Dv) to the number average particle diameter (Dn) thereof is 1.17. In addition, the number average molecular weight and weight average molecular weight of the resin were 59,800 and 140,000, respectively.

6. Preparation of Particulate Vinyl Resin Dispersion 3 for Use as Resin A

The following components were fed into a reaction vessel equipped with a condenser, an agitator and a nitrogen feed pipe.

| | |
|---|---|
| Sodium dodecylsulfate | 0.2 parts |
| Ion exchange water | 498 parts |

The mixture was heated to 80° C. while agitated to prepare a solution. A potassium persulfate solution, which had been prepared by dissolving 2.8 parts of potassium persulfate in 110 parts of ion exchange water, was added to the solution.

After 15 minutes passed, a monomer mixture of the below-mentioned components was dropped into the mixture over 90 minutes.

| | |
|---|---|
| Styrene monomer | 140 parts |
| Methacrylic acid | 60 parts |
| n-Octanethiol | 0.3 parts |

The mixture was further heated for 60 minutes at 80° C. to perform a polymerization reaction, followed by cooling.

Thus, a white dispersion of a particulate vinyl resin 3 was prepared.

It was confirmed that the particulate vinyl resin 3 has a volume average particle diameter (Dv) of 218 nm, and the ratio (Dv/Dn) of the volume average particle diameter (Dv) to the number average particle diameter (Dn) thereof is 1.16. In addition, the number average molecular weight and weight average molecular weight of the resin were 59,100 and 132,000, respectively.

7. Preparation of Particulate Vinyl Resin Dispersion 4 for Use as Resin A

The following components were contained in a reaction vessel equipped with a condenser, an agitator and a nitrogen feed pipe to perform a polymerization reaction for 10 hours at 60° C. under nitrogen gas flow.

| | |
|---|---|
| Styrene monomer | 140 parts |
| Methacrylic acid | 60 parts |
| Acetone | 60 parts |
| 2,2'-Azobis(2,4-dimethylvaleronitrile) | 4 parts |

After the reaction product was heated to 150° C. and then cooled to room temperature. Next, acetone was added to the reaction product to adjust the solid content to 76%. In addition, a sodium dodecylsulfate solution, which had been prepared by dissolving 1.2 parts of sodium dodecylsulfate in 610 parts of ion exchange water, was added thereto, followed by agitation using a TK HOMOMIXER mixer from Tokushu Kika Kogyo Co., Ltd. to prepare an emulsion. Further, acetone was removed therefrom using a rotary evaporator. Thus, a white dispersion of a particulate vinyl resin 4 was prepared.

It was confirmed that the particulate vinyl resin 4 has a volume average particle diameter (Dv) of 135 nm, and the ratio (Dv/Dn) of the volume average particle diameter (Dv) to the number average particle diameter (Dn) thereof is 1.29. In addition, the number average molecular weight and weight average molecular weight of the resin were 47,000 and 123,000, respectively.

8. Preparation of Vinyl Resin 5 for Use as Resin A

The following components were contained in a reaction vessel equipped with a condenser, an agitator and a nitrogen feed pipe to perform a polymerization reaction for 10 hours at 60° C. under nitrogen gas flow.

| | |
|---|---|
| Styrene monomer | 140 parts |
| Methacrylic acid | 60 parts |
| Acetone | 60 parts |
| 2,2'-Azobis(2,4-dimethylvaleronitrile) | 4 parts |

The reaction product was heated to 150° C. to remove acetone therefrom. Thus, a solid vinyl resin 5 was prepared.

9. Preparation of Particulate Vinyl Resin Dispersion 6 for Use as Resin A

The following components were mixed to prepare a dispersion of a particulate vinyl resin 6.

| | |
|---|---|
| Particulate vinyl resin dispersion 1 | 1 part |
| Particulate vinyl resin dispersion 3 | 1 part |

10. Preparation of Vinyl Resin Solution 7 for Use as Resin A

The following components were mixed in a vessel equipped with an agitator.

| | |
|---|---|
| Particulate vinyl resin dispersion 1 | 10 parts |
| Ion exchange water | 40 parts |

Next, a 10% by weight aqueous solution of sodium hydroxide was added thereto to adjust the pH of the dispersion to 9.5 while agitating the mixture. As a result, a transparent aqueous solution of the particulate vinyl resin 1 (hereinafter referred to as a vinyl resin solution 7) was prepared.

11. Preparation of Particulate Vinyl Resin Dispersion 8 for Use as Resin A

The following components were fed into a reaction vessel equipped with a condenser, an agitator and a nitrogen feed pipe.

| | |
|---|---|
| Sodium dodecylsulfate | 1.4 parts |
| Ion exchange water | 498 parts |

The mixture was heated to 80° C. while agitated to prepare a solution. A potassium persulfate solution, which had been prepared by dissolving 2.7 parts of potassium persulfate in 108 parts of ion exchange water, was added to the solution.

After 15 minutes passed, a monomer mixture of the below-mentioned components was dropped into the mixture over 90 minutes.

| | |
|---|---|
| Styrene monomer | 160 parts |
| Methacrylic acid | 40 parts |
| n-Octanethiol | 0.4 parts |

The mixture was further heated for 60 minutes at 80° C. to perform a polymerization reaction, followed by cooling.

Thus, a bluish white dispersion of a particulate vinyl resin 8 was prepared.

It was confirmed that the particulate vinyl resin 8 has a volume average particle diameter (Dv) of 51 nm, a number average molecular weight of 45,100, and a weight average molecular weight of 103,100.

12. Preparation of Particulate Vinyl Resin Dispersion 9 for Use as Resin A

The following components were fed into a reaction vessel equipped with a condenser, an agitator and a nitrogen feed pipe.

| | |
|---|---|
| Sodium dodecylsulfate | 0.7 parts |
| Ion exchange water | 498 parts |

The mixture was heated to 80° C. while agitated to prepare a solution. A potassium persulfate solution, which had been prepared by dissolving 2.7 parts of potassium persulfate in 108 parts of ion exchange water, was added to the solution.

After 15 minutes passed, a monomer mixture of the below-mentioned components was dropped into the mixture over 90 minutes.

| | |
|---|---|
| Styrene monomer | 160 parts |
| Methacrylic acid | 40 parts |
| n-Octanethiol | 0.4 parts |

The mixture was further heated for 60 minutes at 80° C. to perform a polymerization reaction, followed by cooling.

Thus, a white dispersion of a particulate vinyl resin 9 was prepared.

It was confirmed that the particulate vinyl resin 9 has a volume average particle diameter (Dv) of 103 nm, a number average molecular weight of 48,900, and a weight average molecular weight of 112,500.

13. Preparation of Particulate Vinyl Resin Dispersion 10 for Use as Resin A

The following components were fed into a reaction vessel equipped with a condenser, an agitator and a nitrogen feed pipe.

| | |
|---|---|
| Sodium dodecylsulfate | 0.2 parts |
| Ion exchange water | 498 parts |

The mixture was heated to 80° C. while agitated to prepare a solution. A potassium persulfate solution, which had been prepared by dissolving 2.7 parts of potassium persulfate in 108 parts of ion exchange water, was added to the solution.

After 15 minutes passed, a monomer mixture of the below-mentioned components was dropped into the mixture over 90 minutes.

| | |
|---|---|
| Styrene monomer | 160 parts |
| Methacrylic acid | 40 parts |
| n-Octanethiol | 0.4 parts |

The mixture was further heated for 60 minutes at 80° C. to perform a polymerization reaction, followed by cooling.

Thus, a white dispersion of a particulate vinyl resin 10 was prepared.

It was confirmed that the particulate vinyl resin 10 has a volume average particle diameter (Dv) of 227 nm, a number average molecular weight of 48,400, and a weight average molecular weight of 108,000.

14. Preparation of Particulate Vinyl Resin Dispersion 11 for Use as Resin A

The following components were fed into a reaction vessel equipped with a condenser, an agitator and a nitrogen feed pipe.

| | |
|---|---|
| Sodium dodecylsulfate | 1.4 parts |
| Ion exchange water | 498 parts |

The mixture was heated to 80° C. while agitated to prepare a solution. A potassium persulfate solution, which had been prepared by dissolving 2.7 parts of potassium persulfate in 110 parts of ion exchange water, was added to the solution.

After 15 minutes passed, a monomer mixture of the below-mentioned components was dropped into the mixture over 90 minutes.

| | |
|---|---|
| Styrene monomer | 70 parts |
| Butyl acrylate | 40 parts |
| Methacrylic acid | 90 parts |
| n-Octanethiol | 0.2 parts |

The mixture was further heated for 60 minutes at 80° C. to perform a polymerization reaction, followed by cooling.

Thus, a bluish white dispersion of a particulate vinyl resin 11 was prepared.

It was confirmed that the particulate vinyl resin 11 has a volume average particle diameter (Dv) of 38 nm, a number average molecular weight of 69,700, and a weight average molecular weight of 157,000.

15. Preparation of Particulate Vinyl Resin Dispersion 12 for Use as Resin A

The following components were fed into a reaction vessel equipped with a condenser, an agitator and a nitrogen feed pipe.

| | |
|---|---|
| Sodium dodecylsulfate | 0.8 parts |
| Ion exchange water | 498 parts |

The mixture was heated to 80° C. while agitated to prepare a solution. A potassium persulfate solution, which had been prepared by dissolving 2.7 parts of potassium persulfate in 110 parts of ion exchange water, was added to the solution.

After 15 minutes passed, a monomer mixture of the below-mentioned components was dropped into the mixture over 90 minutes.

| | |
|---|---|
| Styrene monomer | 70 parts |
| Butyl acrylate | 40 parts |
| Methacrylic acid | 90 parts |
| n-Octanethiol | 0.2 parts |

The mixture was further heated for 60 minutes at 80° C. to perform a polymerization reaction, followed by cooling.

Thus, a white dispersion of a particulate vinyl resin 12 was prepared.

It was confirmed that the particulate vinyl resin 12 has a volume average particle diameter (Dv) of 89 nm, a number average molecular weight of 70,100, and a weight average molecular weight of 165,000.

16. Preparation of Particulate Vinyl Resin Dispersion 13 for Use as Resin A

The following components were fed into a reaction vessel equipped with a condenser, an agitator and a nitrogen feed pipe.

| | |
|---|---|
| Sodium dodecylsulfate | 0.2 parts |
| Ion exchange water | 498 parts |

The mixture was heated to 80° C. while agitated to prepare a solution. A potassium persulfate solution, which had been prepared by dissolving 2.7 parts of potassium persulfate in 110 parts of ion exchange water, was added to the solution.

After 15 minutes passed, a monomer mixture of the below-mentioned components was dropped into the mixture over 90 minutes.

| | |
|---|---|
| Styrene monomer | 70 parts |
| Butyl acrylate | 40 parts |
| Methacrylic acid | 90 parts |
| n-Octanethiol | 0.2 parts |

The mixture was further heated for 60 minutes at 80° C. to perform a polymerization reaction, followed by cooling.

Thus, a white dispersion of a particulate vinyl resin 13 was prepared.

It was confirmed that the particulate vinyl resin 13 has a volume average particle diameter (Dv) of 190 nm, a number average molecular weight of 70,900, and a weight average molecular weight of 171,000.

17. Preparation of Particulate Vinyl Resin Dispersion 14 for Use as Resin A

The following components were contained in a reaction vessel equipped with a condenser, an agitator and a nitrogen feed pipe to perform a polymerization reaction for 10 hours at 60° C. under nitrogen gas flow.

| | |
|---|---|
| Styrene monomer | 138 parts |
| Methacrylic acid | 54 parts |
| Acrylamide-2-methylpropane sulfonic acid | 8 parts |
| Acetone | 60 parts |
| 2,2'-Azobis (2,4-dimethylvaleronitrile) | 4 parts |

After the reaction product was heated to 150° C. and then cooled to room temperature. Next, acetone was added to the reaction product to adjust the solid content of the reaction product to 76%. In addition, a sodium dodecylsulfate solution, which had been prepared by dissolving 1.2 parts of sodium dodecylsulfate in 610 parts of ion exchange water, was added thereto, followed by agitation using a TK HOMO-MIXER mixer from Tokushu Kika Kogyo Co., Ltd. to prepare an emulsion. Further, acetone was removed therefrom using a rotary evaporator. Thus, a white dispersion of a particulate vinyl resin 14 was prepared.

It was confirmed that the particulate vinyl resin 14 has a volume average particle diameter (Dv) of 66 nm, and the ratio (Dv/Dn) of the volume average particle diameter (Dv) to the number average particle diameter (Dn) thereof is 1.31. In addition, the number average molecular weight and weight average molecular weight of the resin were 59,000 and 153,000, respectively.

18. Preparation of Vinyl Resin 15 for Use as Resin A

The following components were contained in a reaction vessel equipped with a condenser, an agitator and a nitrogen feed pipe to perform a polymerization reaction for 10 hours at 60° C. under nitrogen gas flow.

| | |
|---|---|
| Styrene monomer | 138 parts |
| Methacrylic acid | 54 parts |
| Acrylamide-2-methylpropane sulfonic acid | 8 parts |
| Acetone | 60 parts |
| 2,2'-Azobis (2,4-dimethylvaleronitrile) | 4 parts |

After the reaction product was heated to 150° C. to remove acetone from the reaction product. Thus, a vinyl resin 15 was prepared.

19. Preparation of Particulate Vinyl Resin Dispersion 16 for Use as Resin A

The following components were fed into a reaction vessel equipped with a condenser, an agitator and a nitrogen feed pipe.

| | |
|---|---|
| Sodium dodecylsulfate | 1.3 parts |
| Ion exchange water | 498 parts |

The mixture was heated to 80° C. while agitated to prepare a solution. A potassium persulfate solution, which had been prepared by dissolving 2.5 parts of potassium persulfate in 101 parts of ion exchange water, was added to the solution.

After 15 minutes passed, a monomer mixture of the below-mentioned components was dropped into the mixture over 90 minutes.

| | |
|---|---|
| Styrene monomer | 140 parts |
| Butyl acrylate | 44 parts |
| Methacrylic acid | 16 parts |
| n-Octanethiol | 0.3 parts |

The mixture was further heated for 60 minutes at 80° C. to perform a polymerization reaction, followed by cooling.

Thus, a white dispersion of a particulate vinyl resin 16 was prepared.

It was confirmed that the particulate vinyl resin 16 has a volume average particle diameter (Dv) of 67 nm, a number average molecular weight of 58,200, and a weight average molecular weight of 123,000.

20. Preparation of Particulate Vinyl Resin Dispersion 17 for Use as Resin A

The following components were fed into a reaction vessel equipped with a condenser, an agitator and a nitrogen feed pipe.

| | |
|---|---|
| Sodium dodecylsulfate | 0.7 parts |
| Ion exchange water | 498 parts |

The mixture was heated to 80° C. while agitated to prepare a solution. A potassium persulfate solution, which had been prepared by dissolving 2.5 parts of potassium persulfate in 101 parts of ion exchange water, was added to the solution.

After 15 minutes passed, a monomer mixture of the below-mentioned components was dropped into the mixture over 90 minutes.

| | |
|---|---|
| Styrene monomer | 140 parts |
| Butyl acrylate | 44 parts |
| Methacrylic acid | 16 parts |
| n-Octanethiol | 0.3 parts |

The mixture was further heated for 60 minutes at 80° C. to perform a polymerization reaction, followed by cooling.

Thus, a white dispersion of a particulate vinyl resin 17 was prepared.

It was confirmed that the particulate vinyl resin 17 has a volume average particle diameter (Dv) of 113 nm, a number average molecular weight of 58,900, and a weight average molecular weight of 133,000.

21. Preparation of Particulate Vinyl Resin Dispersion 18 for Use as Resin A

The following components were fed into a reaction vessel equipped with a condenser, an agitator and a nitrogen feed pipe.

| | |
|---|---|
| Sodium dodecylsulfate | 0.2 parts |
| Ion exchange water | 498 parts |

The mixture was heated to 80° C. while agitated to prepare a solution. A potassium persulfate solution, which had been prepared by dissolving 2.5 parts of potassium persulfate in 101 parts of ion exchange water, was added to the solution.

After 15 minutes passed, a monomer mixture of the below-mentioned components was dropped into the mixture over 90 minutes.

| | |
|---|---|
| Styrene monomer | 140 parts |
| Butyl acrylate | 44 parts |
| Methacrylic acid | 16 parts |
| n-Octanethiol | 0.3 parts |

The mixture was further heated for 60 minutes at 80° C. to perform a polymerization reaction, followed by cooling.

Thus, a white dispersion of a particulate vinyl resin 18 was prepared.

It was confirmed that the particulate vinyl resin 18 has a volume average particle diameter (Dv) of 233 nm, a number average molecular weight of 60,000, and a weight average molecular weight of 143,000.

22. Preparation of Particulate Vinyl Resin Dispersion 19 for Use as Resin A

The following components were contained in a reaction vessel equipped with a condenser, an agitator and a nitrogen feed pipe to perform a polymerization reaction for 10 hours at 60° C. under nitrogen gas flow.

| | |
|---|---|
| Styrene monomer | 120 parts |
| Acrylic acid | 44 parts |
| 2-Ethylhexyl methacrylate | 30 parts |
| Compound having the following formula | 6 parts |
| $CH_2{=}CH$ | |
| $O{=}C{-}NH{-}C(CH_3)_2{-}SO_3CH_3$ | |
| Acetone | 60 parts |
| 2,2'-Azobis (2,4-dimethylvaleronitrile) | 4 parts |

After the reaction product was heated to 150° C., followed by cooling to room temperature, acetone was added to the reaction product to adjust the solid content to 76%. Next, a sodium dodecylsulfate solution, which had been prepared by dissolving 1.2 parts of sodium dodecylsulfate in 610 parts of ion exchange water, was added thereto, and the mixture was agitated by a TIC HOMOMIXER mixer from Tokushu Kika Kogyo K.K. to prepare an emulsion. Further, acetone was removed from the emulsion using a rotary evaporator. Thus, a white dispersion of a particulate vinyl resin 19 was prepared.

It was confirmed that the particulate vinyl resin 19 has a volume average particle diameter (Dv) of 93 nm, and the ratio (Dv/Dn) of the volume average particle diameter (Dv) to the number average particle diameter (Dn) thereof is 1.15. In addition, the number average molecular weight and weight average molecular weight of the resin were 39,000 and 108,000, respectively.

23. Preparation of Vinyl Resin 20 for Use as Resin A

The following components were contained in a reaction vessel equipped with a condenser, an agitator and a nitrogen feed pipe to perform a polymerization reaction for 10 hours at 60° C. under nitrogen gas flow.

| | |
|---|---|
| Styrene monomer | 120 parts |
| Acrylic acid | 44 parts |
| 2-Ethylhexyl methacrylate | 30 parts |
| Compound having the following formula | 6 parts |
| $CH_2{=}CH$ | |
| $O{=}C{-}NH{-}C(CH_3)_2{-}SO_3CH_3$ | |
| Acetone | 60 parts |
| 2,2'-Azobis (2,4-dimethylvaleronitrile) | 4 parts |

The reaction product was heated to 150° C. to remove acetone from the reaction product. Thus, a vinyl resin 20 was prepared.

24. Preparation of Particulate Vinyl Resin Dispersion 21 for Use as Resin A

The following components were contained in a reaction vessel equipped with a condenser, an agitator and a nitrogen feed pipe to perform a polymerization reaction for 10 hours at 60° C. under nitrogen gas flow.

| | |
|---|---|
| Styrene monomer | 150 parts |
| Acrylic acid | 42 parts |

-continued

| | |
|---|---|
| Compound having the following formula | 8 parts |

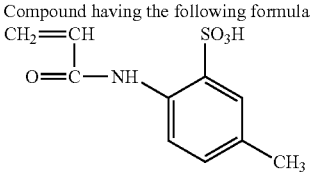

| | |
|---|---|
| Acetone | 60 parts |
| 2,2'-Azobis (2,4-dimethylvaleronitrile) | 4 parts |

After the reaction product was heated to 150° C., followed by cooling to room temperature, acetone was added to the reaction product to adjust the solid content to 76%. Next, a sodium dodecylsulfate solution, which had been prepared by dissolving 1.2 parts of sodium dodecylsulfate in 610 parts of ion exchange water, was added thereto, and the mixture was agitated by a TK HOMOMIXER mixer from Tokushu Kika Kogyo K.K. to prepare an emulsion. Further, acetone was removed from the emulsion using a rotary evaporator. Thus, a white dispersion of a particulate vinyl resin 21 was prepared.

It was confirmed that the particulate vinyl resin 21 has a volume average particle diameter (Dv) of 111 nm, and the ratio (Dv/Dn) of the volume average particle diameter (Dv) to the number average particle diameter (Dn) thereof is 1.15. In addition, the number average molecular weight and weight average molecular weight of the resin were 40,000 and 116,000, respectively.

25. Preparation of Vinyl Resin 22 for Use as Resin A

The following components were contained in a reaction vessel equipped with a condenser, an agitator and a nitrogen feed pipe to perform a polymerization reaction for 12 hours at 60° C. under nitrogen gas flow.

| | |
|---|---|
| Styrene monomer | 150 parts |
| Acrylic acid | 42 parts |
| Compound having the following formula | 8 parts |

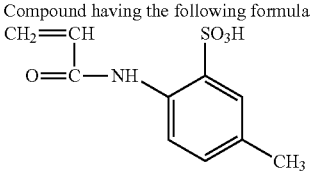

| | |
|---|---|
| Acetone | 60 parts |
| 2,2'-Azobis (2,4-dimethylvaleronitrile) | 4 parts |

The reaction product was heated to 150° C. to remove acetone from the reaction product. Thus, a vinyl resin 22 was prepared.

The solubilities of the thus prepared vinyl resins at pH of 3.0 and 10.0, which were measured by the method mentioned above, are shown in Table 1-2 below.

26. Preparation of Prepolymer 1

The following components were contained in a reaction vessel equipped with a condenser, an agitator and a nitrogen feed pipe to be reacted for 8 hours at 230° C. under normal pressure.

| | |
|---|---|
| Ethylene oxide adduct (2 mole) of bisphenol A | 682 parts |
| Propylene oxide adduct (2 mole) of bisphenol A | 81 parts |

-continued

| | |
|---|---|
| Terephthalic acid | 283 parts |
| Trimellitic anhydride | 22 parts |
| Dibutyl tin oxide | 2 parts |

The reaction was further continued for 5 hours under a reduced pressure of from 10 mmHg to 15 mmHg (1.33 Pa to 2.00 Pa).

Thus, an intermediate polyester 1 was prepared.

It was confirmed that the intermediate polyester 1 has a number average molecular weight of 2,100, a weight average molecular weight (Mw) of 9,500, a glass transition temperature (Tg) of 55° C., an acid value of 0.5 mgKOH/g, and a hydroxyl value of 49 mgKOH/g.

Next, the following components were contained in a reaction vessel equipped with a condenser, an agitator and a nitrogen feed pipe to be reacted for 5 hours at 100° C.

| | |
|---|---|
| Intermediate polyester 1 | 411 parts |
| Isophorone diisocyanate | 89 parts |
| Ethyl acetate | 500 parts |

Thus, a polyester prepolymer 1 having an isocyanate group was prepared. The content of free isocyanate therein was 1.53% by weight.

27. Preparation of Master Batch 1

The following components were mixed with a HENSCHEL MIXER mixer.

| | |
|---|---|
| Water | 30 parts |
| Carbon black | 40 parts |
| Polyester 1 prepared above | 60 parts |

The mixture was kneaded by a two-roll mill for 45 minutes at 130° C., followed by roll cooling and pulverization using a pulverizer. Thus, a master batch 1 having a particle size of 1 mm was prepared.

Example 1

(1) Preparation of Aqueous Phase Liquid

The following components were mixed.

| | |
|---|---|
| Ion exchange water | 970 parts |
| Particulate vinyl resin dispersion 1 prepared above | 40 parts |
| 48.5% by weight aqueous solution of sodium dodecyldiphenyletherdisulfonate | 45 parts |

As a result, an opaque yellow aqueous medium was obtained.

When a 10% by weight aqueous solution of sodium hydroxide was added to adjust the pH of the mixture to 10.0, the particulate vinyl resin was dissolved, and a transparent aqueous phase liquid was prepared. Thus, an aqueous phase liquid 1 was prepared.

(2) Preparation of Oil Phase Liquid

The following components were contained in a reaction vessel equipped with an agitator and a thermometer.

| | |
|---|---|
| Polyester resin 1 prepared above | 545 parts |
| Paraffin wax (melting point of 74° C.) | 181 parts |
| Ethyl acetate | 1,450 parts |

The mixture was heated to 80° C. while agitated. After being agitated for 5 hours at 80° C., the mixture was cooled to 30° C. over one hour.

Next, 500 parts of the master batch 1 and 100 parts of ethyl acetate were added thereto and the mixture was agitated for one hour. Thus, a toner component solution 1 was prepared.

Further, 1,500 parts of the toner component solution 1 was subjected to a dispersion treatment using a bead mill (ULTRAVISCOMILL from Aimex Co., Ltd.) to disperse the carbon black and paraffin wax. The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Next, 655 parts of a 66% ethyl acetate solution of the polyester resin 1 was added thereto. The mixture was subjected to a dispersion treatment using the bead mill. The dispersion conditions were the same as those mentioned above except that the dispersion operation was performed once (i.e., one pass).

Thus, a pigment/wax dispersion 1 was prepared.

Next, the following components were contained in a vessel.

| | |
|---|---|
| Pigment/wax dispersion 1 prepared above | 976 parts |
| Prepolymer 1 prepared above | 88 parts |

The components were mixed for 1 minute using a TK HOMOMIXER mixer from Tokushu Kika Kogyo K.K., whose rotor was rotated at a revolution of 5,000 rpm. Thus, an oil phase liquid 1 (i.e., toner component liquid) was prepared.

(3) Preparation of Emulsion

The below-mentioned components were mixed for 2 minutes in a vessel using a TK HOMOMIXER mixer, whose rotor was rotated at a revolution of from 8,000 to 15,000 rpm, followed by agitation for 10 minutes using an agitator having an anchor-form rotor to prepare an emulsion 1 in which droplets of the oil phase liquid 1 are dispersed in the aqueous phase liquid 1.

| | |
|---|---|
| Oil phase liquid 1 | 1,064 parts |
| Aqueous phase liquid 1 | 1,100 parts |

(4) Solvent Removal

The emulsion 1 was contained in a vessel equipped with an agitator and a thermometer, and heated for 8 hours at 30° C. to remove the organic solvent (i.e., ethyl acetate). Thus, a colored particulate resin dispersion 1 was prepared.

(5) Washing and Drying

1) One hundred (100) parts of the colored particulate resin dispersion 1 was filtered under a reduced pressure to prepare a cake.

2) One hundred (100) parts of ion exchange water was added to the cake and the mixture was agitated for 10 minutes with a TK HOMOMIXER mixer rotated at a revolution of 12,000 rpm, followed by filtering to prepare a cake (a).

3) Nine hundred (900) parts of ion exchange water was added to the cake (a) and the mixture was agitated for 30 minutes with a TK HOMOMIXER mixer rotated at a revolution of 12,000 rpm while transmitting supersonic vibration thereto, followed by filtering under a reduced pressure. This washing operation was repeated until the electroconductivity of the resultant slurry became not greater than 10 μC/cm.

4) A 10% aqueous solution of hydrochloric acid was added to the slurry so that the mixture has a pH of 4, and the mixture was agitated for 30 minutes by an agitator, followed by filtering to prepare a cake (b).

5) One hundred (100) parts of ion exchange water was added to the cake (b) and the mixture was agitated for 10 minutes by the TK HOMOMIXER mixer rotated at a speed of 12,000 rpm. This operation was repeated until the electroconductivity of the resultant slurry became not greater than 10 μC/cm. Thus, a filtered cake 1 was prepared.

The filtered cake 1 was dried for 48 hours at 32° C. using an air dryer, followed by sieving with a screen having openings of 75 μm to prepare a colored particulate resin 1 (i.e., a mother toner (toner particles) 1).

(6) Preparation of Toner

The following components were mixed using a HENSCHEL MIXER mixer.

| | |
|---|---|
| Colored particulate resin 1 prepared above | 100 parts |
| Hydrophobized silica | 0.5 parts |
| Hydrophobized titanium oxide | 0.5 parts |

Thus, a toner of Example 1 (hereinafter referred to as toner 1) was prepared.

Examples 2 to 4

The procedure for preparation of the toner 1 was repeated except that the particulate vinyl resin dispersion 1 was replaced with each of the particulate vinyl resin dispersions 2 to 4. Thus, toners of Examples 2 to 4 (i.e., toners 2 to 4) were prepared.

Example 5

The procedure for preparation of the toner 1 was repeated except that the aqueous phase liquid 1 was replaced with the following aqueous phase liquid 5.

Preparation of Aqueous Phase Liquid 5

The following components were mixed.

| | |
|---|---|
| Ion exchange water | 1,000 parts |
| Particulate vinyl resin 5 prepared above | 10 parts |
| 48.5% by weight aqueous solution of sodium dodecyldiphenyletherdisulfonate | 45 parts |

A 10% by weight aqueous solution of sodium hydroxide was added thereto while agitating the mixture to adjust the pH of the mixture to 10.0. When the mixture was agitated for one hour, the particulate vinyl resin 5 was dissolved therein, and a transparent aqueous phase liquid 5 was prepared.

Thus, a toner of Example 5 (toner 5) was prepared.

Example 6

The procedure for preparation of the toner 1 was repeated except that the particulate vinyl resin dispersion 1 was replaced with the particulate vinyl resin dispersion 6.

Thus, a toner of Example 6 (toner 6) was prepared.

Example 7

The procedure for preparation of the toner 1 was repeated except that the aqueous phase liquid 1 was replaced with the following aqueous phase liquid 7.

Preparation of Aqueous Phase Liquid 7

The following components were mixed.

| | |
|---|---|
| Ion exchange water | 820 parts |
| Particulate vinyl resin solution 7 prepared above | 200 parts |
| 48.5% by weight aqueous solution of sodium dodecyldiphenyletherdisulfonate | 95 parts |

A 10% by weight aqueous solution of sodium hydroxide was added thereto while agitating the mixture to adjust the pH of the mixture to 10.0. As a result, a transparent yellow aqueous phase liquid 7 was prepared.

Thus, a toner of Example 7 (toner 7) was prepared.

Example 8

The procedure for preparation of the toner 1 was repeated except that the aqueous phase liquid 1 was replaced with the following aqueous phase liquid 8.

Preparation of Aqueous Phase Liquid 8

The following components were mixed.

| | |
|---|---|
| Ion exchange water | 970 parts |
| Particulate vinyl resin dispersion 8 prepared above | 40 parts |
| 48.5% by weight aqueous solution of sodium dodecyldiphenyletherdisulfonate | 95 parts |

As a result, an opaque yellow aqueous phase liquid was obtained. When a 10% by weight aqueous solution of potassium hydroxide was added thereto while agitating the mixture to adjust the pH of the mixture to 10.5, the vinyl resin 8 was dissolved therein and a transparent aqueous phase liquid 8 was prepared.

Thus, a toner of Example 8 (toner 8) was prepared.

Examples 9 and 10

The procedure for preparation of the toner 8 was repeated except that the particulate vinyl resin dispersion 8 was replaced with each of the particulate vinyl resin dispersions 9 and 10.

Thus, toners of Examples 9 and 10 (toners 9 and 10) were prepared.

Examples 11 to 13

The procedure for preparation of the toner 1 was repeated except that the particulate vinyl resin dispersion 1 was replaced with each of the particulate vinyl resin dispersions 11 to 13, and the pH of the aqueous phase liquid was changed from 10.0 to 9.6.

Thus, toners of Examples 11 to 13 (toners 11 to 13) were prepared.

Example 14

The procedure for preparation of the toner 1 was repeated except that the aqueous phase liquid 1 was replaced with the following aqueous phase liquid 14.

Preparation of Aqueous Phase Liquid 14

The following components were mixed.

| | |
|---|---|
| Ion exchange water | 970 parts |
| Particulate vinyl resin dispersion 14 prepared above | 40 parts |
| 48.5% by weight aqueous solution of sodium dodecyldiphenyletherdisulfonate | 35 parts |

As a result, an opaque yellow aqueous phase liquid was obtained. When a 10% by weight aqueous solution of sodium hydroxide was added thereto while agitating the mixture to adjust the pH of the mixture to 9.8, a transparent yellow aqueous phase liquid 14 was prepared.

Thus, a toner of Example 14 (toner 14) was prepared.

Example 15

The procedure for preparation of the toner 1 was repeated except that the aqueous phase liquid 1 was replaced with the following aqueous phase liquid 15.

Preparation of Aqueous Phase Liquid 15

The following components were mixed.

| | |
|---|---|
| Ion exchange water | 1,000 parts |
| Vinyl resin 15 prepared above | 10 parts |
| 48.5% by weight aqueous solution of sodium dodecyldiphenyletherdisulfonate | 35 parts |

A 10% by weight aqueous solution of sodium hydroxide was added thereto while agitating the mixture to adjust the pH of the mixture to 9.8. When the mixture was agitated for one hour, the vinyl resin 15 was dissolved therein, and a transparent aqueous phase liquid 15 was prepared.

Thus, a toner of Example 15 (toner 15) was prepared.

Example 16

(1) Preparation of Aqueous Phase Liquid

The following components were mixed.

| | |
|---|---|
| Ion exchange water | 970 parts |
| Particulate vinyl resin dispersion 1 prepared above | 40 parts |
| 48.5% by weight aqueous solution of sodium dodecyldiphenyletherdisulfonate | 95 parts |

As a result, an opaque yellow aqueous medium was obtained.

When a 10% by weight aqueous solution of sodium hydroxide was added to adjust the pH of the mixture to 10.2, the particulate vinyl resin was dissolved, and a transparent aqueous phase liquid 16 was prepared.

(2) Preparation of Oil Phase Liquid

The following components were contained in a reaction vessel equipped with an agitator and a thermometer.

| | |
|---|---|
| Polyester resin 2 prepared above | 175 parts |
| Polyester resin 3 prepared above | 430 parts |
| Paraffin wax (melting point of 74° C.) | 153 parts |
| Ethyl acetate | 1,450 parts |

The mixture was heated to 80° C. while agitated. After being agitated for 5 hours at 80° C., the mixture was cooled to 30° C. over one hour.

Next, 410 parts of the master batch 1 and 100 parts of ethyl acetate were added thereto and the mixture was agitated for one hour. Thus, a toner component solution 16 was prepared.

Further, 1,500 parts of the toner component solution 16 was subjected to a dispersion treatment using a bead mill (ULTRAVISCOMILL from Aimex Co., Ltd.) to disperse the carbon black and paraffin wax. The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Next, 470 parts of a 70% by weight ethyl acetate solution of the polyester resin 2,250 parts of a 55% by weight ethyl acetate solution of the polyester resin 3, and 95 parts of ethyl acetate were added thereto. The mixture was subjected to a dispersion treatment using the bead mill. The dispersion conditions are the same as those mentioned above except that the dispersion operation was performed once (i.e., one pass).

Thus, an oil phase liquid 16 was prepared.

(3) Preparation of Emulsion

The following components were mixed for 2 minutes in a vessel using a TK HOMOMIXER mixer, whose rotor was rotated at a revolution of from 8,000 to 15,000 rpm, to prepare an emulsion 16 in which droplets of the oil phase liquid 16 are dispersed in the aqueous phase liquid 16.

| | |
|---|---|
| Oil phase liquid 16 | 976 parts |
| Aqueous phase liquid 16 | 1,200 parts |

The thus prepared emulsion 16 was subjected to the solvent removal, washing, and drying treatments mentioned above in Example 1 to prepare a colored particulate resin 16 (i.e., a mother toner (toner particles) 16).

(4) Preparation of Toner

The colored particulate resin 16 was mixed with the external additives in the same way as that in Example 1 to prepare a toner of Example 16 (toner 16).

Examples 17 and 18

The procedure for preparation of the toner 16 was repeated except that the particulate vinyl resin dispersion 1 was replaced with each of the particulate vinyl resin dispersions 2 and 3.

Thus, toners of Examples 17 and 18 (toners 17 and 18) were prepared.

Example 19

The procedure for preparation of the toner 1 was repeated except that the aqueous phase liquid 1 was replaced with the following aqueous phase liquid 19.

Preparation of Aqueous Phase Liquid 19

The following components were mixed.

| | |
|---|---|
| Ion exchange water | 970 parts |
| Particulate vinyl resin dispersion 19 prepared above | 40 parts |
| 48.5% by weight aqueous solution of sodium dodecyldiphenyletherdisulfonate | 37 parts |

As a result, an opaque yellow aqueous phase liquid was obtained. When a 10% by weight aqueous solution of sodium hydroxide was added thereto while agitating the mixture to adjust the pH of the mixture to 10.3, a transparent yellow aqueous phase liquid 19 was prepared.

Thus, a toner of Example 19 (toner 19) was prepared.

Example 20

The procedure for preparation of the toner 1 was repeated except that the aqueous phase liquid 1 was replaced with the following aqueous phase liquid 20.

Preparation of Aqueous Phase Liquid 20

The following components were mixed.

| | |
|---|---|
| Ion exchange water | 1,000 parts |
| Vinyl resin 20 prepared above | 10 parts |
| 48.5% by weight aqueous solution of sodium dodecyldiphenyletherdisulfonate | 37 parts |

A 10% by weight aqueous solution of sodium hydroxide was added thereto while agitating the mixture to adjust the pH of the mixture to 10.3. When the mixture was agitated for one hour, the particulate vinyl resin 20 was dissolved therein, and a transparent aqueous phase liquid 20 was prepared.

Thus, a toner of Example 20 (toner 20) was prepared.

Example 21

The procedure for preparation of the toner 1 was repeated except that the aqueous phase liquid 1 was replaced with the following aqueous phase liquid 21.

Preparation of Aqueous Phase Liquid 21

The following components were mixed.

| | |
|---|---|
| Ion exchange water | 970 parts |
| Particulate vinyl resin dispersion 21 prepared above | 40 parts |
| 48.5% by weight aqueous solution of sodium dodecyldiphenyletherdisulfonate | 37 parts |

As a result, an opaque yellow aqueous phase liquid was obtained. When a 10% by weight aqueous solution of sodium hydroxide was added thereto while agitating the mixture to adjust the pH of the mixture to 9.4, a transparent yellow aqueous phase liquid 21 was prepared.

Thus, a toner of Example 21 (toner 21) was prepared.

Example 22

The procedure for preparation of the toner 1 was repeated except that the aqueous phase liquid 1 was replaced with the following aqueous phase liquid 22.

Preparation of Aqueous Phase Liquid 22

The following components were mixed.

| | |
|---|---|
| Ion exchange water | 1,000 parts |
| Vinyl resin 22 prepared above | 10 parts |
| 48.5% by weight aqueous solution of sodium dodecyldiphenyletherdisulfonate | 21 parts |

A 10% by weight aqueous solution of sodium hydroxide was added thereto while agitating the mixture to adjust the pH of the mixture to 9.4. When the mixture was agitated for one hour, the vinyl resin 22 was dissolved therein, and a transparent aqueous phase liquid 22 was prepared.

Thus, a toner of Example 22 (toner 22) was prepared.

Comparative Example 1

(1) Preparation of Aqueous Phase Liquid

The following components were mixed.

| | |
|---|---|
| Ion exchange water | 970 parts |
| Particulate vinyl resin dispersion 1 prepared above | 40 parts |
| 48.5% by weight aqueous solution of sodium dodecyldiphenyletherdisulfonate | 95 parts |

As a result, an opaque yellow aqueous medium (hereinafter referred to as an aqueous phase liquid 101) was obtained.

(2) Preparation of Emulsion

The below-mentioned components were mixed for 2 minutes in a vessel using a TK HOMOMIXER mixer, whose rotor was rotated at a revolution of from 8,000 to 15,000 rpm, followed by agitation for 10 minutes using an agitator having an anchor-form rotor to prepare an emulsion 101 in which droplets of the oil phase liquid 1 are dispersed in the aqueous phase liquid 101.

| | |
|---|---|
| Oil phase liquid 1 prepared in Example 1 | 1,064 parts |
| Aqueous phase liquid 101 prepared above | 1,100 parts |

(3) Solvent Removal

The emulsion 101 was contained in a vessel equipped with an agitator and a thermometer, and heated for 8 hours at 30° C. to remove the organic solvent (i.e., ethyl acetate). Thus, a colored particulate resin dispersion 101 was prepared.

(4) Washing and Drying

1) One hundred (100) parts of the colored particulate resin dispersion 101 was filtered under a reduced pressure to prepare a cake.

2) One hundred (100) parts of ion exchange water was added to the cake and the mixture was agitated for 10 minutes with a TK HOMOMIXER mixer rotated at a revolution of 12,000 rpm, followed by filtering to prepare a cake (a').

3) Nine hundred (900) parts of ion exchange water was added to the cake (a') and the mixture was agitated for 30 minutes with a TK HOMOMIXER mixer rotated at a revolution of 12,000 rpm while transmitting supersonic vibration thereto, followed by filtering under a reduced pressure. This washing operation was repeated until the electroconductivity of the resultant slurry became not greater than 10 μC/cm.

4) A 10% aqueous solution of hydrochloric acid was added to the slurry so that the mixture has a pH of 4, and the mixture was agitated for 30 minutes by an agitator, followed by filtering to prepare a cake (b').

5) One hundred (100) parts of ion exchange water was added to the cake (b') and the mixture was agitated for 10 minutes by the TK HOMOMIXER mixer rotated at a speed of 12,000 rpm. This operation was repeated until the electroconductivity of the resultant slurry became not greater than 10 μC/cm. Thus, a filtered cake 101 was prepared.

The filtered cake 101 was dried for 48 hours at 32° C. using an air dryer, followed by sieving with a screen having openings of 75 μm to prepare a colored particulate resin 101 (i.e., a mother toner (toner particles) 101).

(5) Preparation of Toner

The following components were mixed using a HENSCHEL MIXER mixer.

| | |
|---|---|
| Colored particulate resin 101 prepared above | 100 parts |
| Hydrophobized silica | 0.5 parts |
| Hydrophobized titanium oxide | 0.5 parts |

Thus, a toner of Comparative Example 1 (hereinafter referred to as toner 101) was prepared.

Comparative Examples 2 to 4

The procedure for preparation of the toner 101 was repeated except that the particulate vinyl resin dispersion 1 was replaced with each of the particulate vinyl resin dispersions 2 to 4.

Thus, toners of Comparative Examples 2 to 4 (i.e., toners 102 to 104) were prepared.

Comparative Example 5

The procedure for preparation of the toner 1 was repeated except that the aqueous phase liquid 1 was replaced with the following aqueous phase liquid 105.

Preparation of Aqueous Phase Liquid 105

The following components were mixed.

| | |
|---|---|
| Ion exchange water | 970 parts |
| Particulate vinyl resin dispersion 16 prepared above | 40 parts |
| 48.5% by weight aqueous solution of sodium dodecyldiphenyletherdisulfonate | 95 parts |

As a result, an opaque yellow aqueous medium was obtained. Even when a 10% by weight aqueous solution of sodium hydroxide was added thereto while agitating the mixture to adjust the pH of the mixture to 10.0, the aqueous medium remained opaque. This aqueous medium was used as the aqueous phase liquid 105.

Thus, a toner of Comparative Example 5 (toner 105) was prepared.

Comparative Examples 6 and 7

The procedure for preparation of the toner 105 was repeated except that the particulate vinyl resin dispersion 16 was replaced with each of the particulate vinyl resin dispersions 17 and 18.

Thus, toners of Comparative Examples 6 and 7 (toners 106 and 107) were prepared.

Comparative Example 8

(1) Preparation of Aqueous Phase Liquid

The following components were mixed.

| | |
|---|---|
| Ion exchange water | 970 parts |
| 48.5% by weight aqueous solution of sodium dodecyldiphenyletherdisulfonate | 120 parts |

A 10% by weight aqueous solution of potassium hydroxide was added thereto while agitating the mixture to adjust the pH of the mixture to 10.8. As a result, a transparent yellow aqueous medium (hereinafter referred to as an aqueous phase liquid 108) was obtained.

(2) Preparation of Emulsion

The below-mentioned components were mixed for 2 minutes in a vessel using a TK HOMOMIXER mixer, whose rotor was rotated at a revolution of from 8,000 to 15,000 rpm, followed by agitation for 10 minutes using an agitator having an anchor-form rotor, whose rotor was rotated at a revolution of from 130 to 350 rpm, to prepare an emulsion 108 in which droplets of the oil phase liquid 1 are dispersed in the aqueous phase liquid 108.

| | |
|---|---|
| Oil phase liquid 1 prepared in Example 1 | 1,090 parts |
| Aqueous phase liquid 108 prepared above | 1,100 parts |

The thus prepared emulsion 108 was subjected to the solvent removal, washing, and drying treatments mentioned above in Example 1 to prepare a colored particulate resin 108 (i.e., a mother toner (toner particles) 108).

(3) Preparation of Toner

The colored particulate resin 16 was mixed with the external additives in the same was as that in Example 1 to prepare a toner of comparative Example 8 (toner 108).

These toners were evaluated as follows.

1. Evaluation of Toner Itself (1) Volume Average Particle Diameter (Dv) and Ratio (Dv/Dn) of Volume Average Particle Diameter (Dv) to Number Average Particle Diameter (Dn)

The method for measuring the volume average particle diameter (Dv) and the ratio (Dv/Dn) is mentioned above.

(2) Initial Development Property of Toner

One hundred (100) grams of a toner was set in a toner cartridge for black color toner of a color laser printer, IPSIO SP C220 from Ricoh Co., Ltd., and the cartridge was set to the laser printer. A copy of a test chart was produced by the laser printer on a recording paper 6220Y from Ricoh Co., Ltd. The lightness (L*) of a background area of the copy was measured with a densitometer X-Rite 939 from X-Rite Incorporated to determine whether the background development is caused by the toner. The development property of the toner is graded as follows.

Very good: The lightness is not lower than 92.7 (i.e., Background development is not visually observed).

Good: The lightness is not lower than 92.3 and lower than 92.7 (i.e., Slight background development is observed when carefully watching the image).

Fair: The lightness is not lower than 91.0 and lower than 92.3 (i.e., Slight background development is observed without carefully watching the image).

Usable: The lightness is not lower than 90.0 and lower than 91.0 (i.e., Background development can be clearly observed, but background development is still on an acceptable level).

Unusable: The lightness is lower than 90.0 (i.e., Serious background development is observed, and background development is on an unacceptable level).

As described in Table 2-2, 43 image forming tests were performed using the toners 1-22 and 101-108.

(3) Charge Quantity Of Toner

After the image forming test mentioned above in paragraph (1), the cartridge was detached from the laser printer, and the charge quantity of the toner on the toner feeding member (i.e., developing roller) of the cartridge was measured.

The charge property of the toner is graded as follows.

Very good: The quantity of negative charge (i.e., absolute value of the charge quantity) is not lower than 30 μC/g. The toner has excellent developing property.

Good: The quantity of negative charge is not lower than 20 μC/g and lower than 30 μC/g. The toner has good developing property.

Usable: The quantity of negative charge is not lower than 15 μC/g and lower than 20 μC/g. The toner has tolerable developing property.

Unusable: The quantity of negative charge is lower than 15 μC/g. The toner has poor developing property, and produces images with background development.

(4) Development Property after Adding Supplementary Toner

After the image forming test mentioned above in paragraph (1), the cartridge was detached from the laser printer, and 3 g of the supplementary toner described in Table 2-2 was fed into the toner feeding portion of the cartridge. The cartridge was then attached to the laser printer to perform the image forming test mentioned above in paragraph (1) and to evaluate the development property of the toner.

As described in Table 2-2, 43 image forming tests were performed by using one or two of the toners 1-22 and 101-108 as the initial toner and supplementary toner. The reason why image forming tests in which the supplementary toner is different from the initial toner were performed is to check whether good images can be produced when the average particle diameter of the resin A is changed due to changes of the manufacturing conditions of the resin A (for example, when a different lot of resin A is used), etc.

The evaluation results are shown in Tables 2-1 and 2-2. In addition, the formula and properties of the resins (used as the resin A) used for the toner of Examples 1-22 and Comparative Examples 1-8 and properties of the aqueous phase liquids thereof are descried in Table 1-1. Further, the solubility of the resins (used as the resin A) in water having a pH of 3.0 and water having a pH of 10.0 is described in Table 1-2.

TABLE 1-1

| | Resin A | | | | | Aqueous phase liquid | |
|---|---|---|---|---|---|---|---|
| | No. | Formula | Condition | Dv (nm) | Dv/Dn | pH | Transparency |
| Ex. 1 | 1 | St/MAA = 70/30 | Emulsion | 40 | 1.14 | 10.0 | TP |
| Ex. 2 | 2 | St/MAA = 70/30 | Emulsion | 92 | 1.17 | 10.0 | TP |
| Ex. 3 | 3 | St/MAA = 70/30 | Emulsion | 218 | 1.16 | 10.0 | TP |
| Ex. 4 | 4 | St/MAA = 70/30 | Emulsion | 135 | 1.29 | 10.0 | TP |
| Ex. 5 | 5 | St/MAA = 70/30 | Solid | — | — | 10.0 | TP |
| Ex. 6 | 6 | St/MAA = 70/30 | Emulsion | 120 | 2.33 | 10.0 | TP |
| Ex. 7 | 7 | St/MAA = 70/30 | Solution | — | — | 10.0 | TP |
| Ex. 8 | 8 | St/MAA = 80/20 | Emulsion | 51 | 1.15 | 10.5 | TP |
| Ex. 9 | 9 | St/MAA = 80/20 | Emulsion | 103 | 1.18 | 10.5 | TP |
| Ex. 10 | 10 | St/MAA = 80/20 | Emulsion | 227 | 1.17 | 10.5 | TP |
| Ex. 11 | 11 | St/BA/MAA = 35/20/45 | Emulsion | 38 | 1.18 | 9.6 | TP |
| Ex. 12 | 12 | St/BA/MAA = 35/20/45 | Emulsion | 89 | 1.17 | 9.6 | TP |
| Ex. 13 | 13 | St/BA/MAA = 35/20/45 | Emulsion | 190 | 1.16 | 9.6 | TP |
| Ex. 14 | 14 | St/MAA/AMPS = 69/27/4 | Emulsion | 66 | 1.31 | 9.8 | TP |
| Ex. 15 | 15 | St/MAA/AMPS = 69/27/4 | Solid | — | — | 9.8 | TP |
| Ex. 16 | 1 | St/MAA = 70/30 | Emulsion | 40 | 1.14 | 10.2 | TP |
| Ex. 17 | 2 | St/MAA = 70/30 | Emulsion | 92 | 1.17 | 10.2 | TP |

TABLE 1-1-continued

| | Resin A | | | | | Aqueous phase liquid | |
|---|---|---|---|---|---|---|---|
| | No. | Formula | Condition | Dv (nm) | Dv/Dn | pH | Transparency |
| Ex. 18 | 3 | St/MAA = 70/30 | Emulsion | 218 | 1.16 | 10.2 | TP |
| Ex. 19 | 19 | St/EHMA/AA/X = 60/15/22/3 | Emulsion | 93 | 1.15 | 10.3 | TP |
| Ex. 20 | 20 | St/EHMA/AA/X = 60/15/22/3 | Solid | — | — | 10.3 | TP |
| Ex. 21 | 21 | St/MAA/Y = 75/21/4 | Emulsion | 111 | 1.15 | 9.4 | TP |
| Ex. 22 | 22 | St/MAA/Y = 75/21/4 | Solid | — | — | 9.4 | TP |
| Comp. Ex. 1 | 1 | St/MAA = 70/30 | Emulsion | 40 | 1.14 | 5.9 | OP |
| Comp. Ex. 2 | 2 | St/MAA = 70/30 | Emulsion | 92 | 1.17 | 5.9 | OP |
| Comp. Ex. 3 | 3 | St/MAA = 70/30 | Emulsion | 218 | 1.16 | 5.9 | OP |
| Comp. Ex. 4 | 4 | St/MAA = 70/30 | Emulsion | 135 | 2.33 | 5.9 | OP |
| Comp. Ex. 5 | 16 | St/BA/MAA = 70/22/8 | Emulsion | 67 | 1.16 | 10.0 | OP |
| Comp. Ex. 6 | 17 | St/BA/MAA = 70/22/8 | Emulsion | 113 | 1.18 | 10.0 | OP |
| Comp. Ex. 7 | 18 | St/BA/MAA = 70/22/8 | Emulsion | 233 | 1.15 | 10.0 | OP |
| Comp. Ex. 8 | — | — | — | — | — | 10.8 | TP |

St: Styrene
BA: Butyl acrylate
EHMA: 2-Ethylhexyl methacrylate
MAA: Methacrylic acid
AA: Acrylic acid
AMPS: Acrylamide-2-methylpropanesulfonic acid
X: $CH_2{=}CHCONH{-}C(CH_3)_2{-}SO_3CH_3$
Y: $CH_2{=}CHCONH{-}C_6H_3(SO_3H)(CH_3)$
TP: Transparent
OP: Opaque

TABLE 1-2

| | Solubility in water | |
|---|---|---|
| No. of resin A | At pH of 3.0 | At pH of 10.0 |
| 1 | Insoluble | Soluble |
| 2 | Insoluble | Soluble |
| 3 | Insoluble | Soluble |
| 4 | Insoluble | Soluble |
| 5 | Insoluble | Soluble |
| 6 | Insoluble | Soluble |
| 7 | Insoluble | Soluble |
| 8 | Insoluble | Soluble |
| 9 | Insoluble | Soluble |
| 10 | Insoluble | Soluble |
| 11 | Insoluble | Soluble |
| 12 | Insoluble | Soluble |
| 13 | Insoluble | Soluble |
| 14 | Insoluble | Soluble |
| 15 | Insoluble | Soluble |
| 16 | Insoluble | Insoluble |
| 17 | Insoluble | Insoluble |
| 18 | Insoluble | Insoluble |
| 19 | Insoluble | Soluble |
| 20 | Insoluble | Soluble |
| 21 | Insoluble | Soluble |
| 22 | Insoluble | Soluble |

TABLE 2-1

| No. of toner | Volume average particle diameter (Dv) (μm) | Ratio (Dv/Dn) of volume average particle diameter (Dv) to number average particle diameter (Dn) |
|---|---|---|
| 1 | 7.6 | 1.18 |
| 2 | 7.6 | 1.17 |
| 3 | 7.8 | 1.16 |
| 4 | 7.7 | 1.17 |
| 5 | 7.7 | 1.16 |
| 6 | 7.6 | 1.17 |
| 7 | 7.6 | 1.17 |
| 8 | 7.9 | 1.15 |
| 9 | 7.8 | 1.16 |
| 10 | 7.9 | 1.16 |
| 11 | 6.9 | 1.18 |
| 12 | 6.8 | 1.18 |
| 13 | 7.0 | 1.17 |
| 14 | 7.0 | 1.17 |
| 15 | 7.1 | 1.16 |
| 16 | 7.3 | 1.16 |
| 17 | 7.5 | 1.17 |
| 18 | 7.6 | 1.14 |
| 19 | 7.1 | 1.14 |
| 20 | 7.2 | 1.15 |
| 21 | 7.4 | 1.13 |
| 22 | 7.2 | 1.14 |
| 101 | 5.8 | 1.16 |
| 102 | 7.9 | 1.16 |
| 103 | 10.3 | 1.20 |

TABLE 2-1-continued

| No. of toner | Volume average particle diameter (Dv) (μm) | Ratio (Dv/Dn) of volume average particle diameter (Dv) to number average particle diameter (Dn) |
|---|---|---|
| 104 | 8.9 | 1.29 |
| 105 | 5.6 | 1.12 |
| 106 | 7.8 | 1.13 |
| 107 | 11.4 | 1.13 |
| 108 | 8.3 | 1.32 |

TABLE 2-2

| No. of | Evaluation of toner itself | | | Evaluation after adding supplementary toner | |
|---|---|---|---|---|---|
| image forming test | No. of toner | Charge quantity (−μC/g) | Background development (L*) | No. of supplementary toner | Background development (L*) |
| 1 | 1 | 24.0 | 93.1 | 1 | 93.0 |
| 2 | 1 | 23.9 | 93.1 | 2 | 92.9 |
| 3 | 2 | 24.3 | 92.9 | 1 | 92.8 |
| 4 | 3 | 23.5 | 93.0 | 1 | 92.9 |
| 5 | 4 | 26.5 | 92.8 | 1 | 92.4 |
| 6 | 5 | 23.0 | 92.9 | 1 | 92.5 |
| 7 | 6 | 25.9 | 92.9 | 1 | 92.9 |
| 8 | 7 | 24.7 | 92.9 | 1 | 92.7 |
| 9 | 8 | 28.8 | 93.1 | 8 | 93.1 |
| 10 | 9 | 29.1 | 93.1 | 8 | 92.9 |
| 11 | 10 | 27.2 | 92.9 | 8 | 93.0 |
| 12 | 11 | 17.2 | 92.1 | 11 | 92.2 |
| 13 | 11 | 17.4 | 92.2 | 12 | 91.9 |
| 14 | 12 | 16.6 | 91.6 | 11 | 91.7 |
| 15 | 13 | 17.4 | 92.0 | 11 | 91.6 |
| 16 | 14 | 32.8 | 93.1 | 14 | 93.0 |
| 17 | 14 | 33.1 | 93.0 | 15 | 92.4 |
| 18 | 15 | 33.3 | 92.9 | 14 | 92.3 |
| 19 | 16 | 26.6 | 92.8 | 16 | 92.9 |
| 20 | 16 | 26.2 | 92.7 | 17 | 92.9 |
| 21 | 17 | 24.9 | 92.8 | 16 | 92.8 |
| 22 | 18 | 25.1 | 93.0 | 16 | 92.8 |
| 23 | 19 | 30.2 | 93.0 | 19 | 92.9 |
| 24 | 19 | 30.7 | 93.1 | 20 | 92.4 |
| 25 | 20 | 30.8 | 92.9 | 19 | 92.3 |
| 26 | 21 | 33.0 | 93.0 | 21 | 92.8 |
| 27 | 21 | 32.7 | 92.9 | 22 | 92.1 |
| 28 | 22 | 32.8 | 93.1 | 21 | 92.4 |
| 29 | 101 | 24.9 | 93.0 | 1 | 86.6 |
| 30 | 101 | 24.7 | 93.0 | 101 | 93.0 |
| 31 | 101 | 25.1 | 92.9 | 102 | 85.0 |
| 32 | 1 | 24.2 | 93.0 | 101 | 87.2 |
| 33 | 102 | 24.4 | 92.9 | 1 | 92.3 |
| 34 | 102 | 24.2 | 93.0 | 101 | 84.6 |
| 35 | 103 | 20.1 | 92.3 | 1 | 83.7 |
| 36 | 103 | 20.5 | 92.3 | 101 | 87.7 |
| 37 | 104 | 22.3 | 91.3 | 1 | 86.2 |
| 38 | 104 | 22.2 | 91.2 | 101 | 83.9 |
| 39 | 105 | 25.3 | 93.1 | 105 | 93.0 |
| 40 | 105 | 25.3 | 93.0 | 107 | 86.9 |
| 41 | 106 | 24.2 | 93.0 | 105 | 89.1 |
| 42 | 107 | 19.8 | 93.0 | 105 | 86.1 |
| 43 | 108 | 20.0 | 85.9 | 108 | 85.6 |

It can be understood from Table 2-2 that even when a toner prepared by using a resin A, whose average particle diameter is different from the resin A used for the initial toner, is used as the supplementary toner (for example, image forming tests 2-8), the toner of the present invention can produce good images without background development, but the comparative toners cause background development (for example, image forming tests 31, 34, 36, 38 and 40-41.) although good images can be produced when the same comparative toner as the initial comparative toner is used as the supplementary toner (for example, image forming tests 30 and 39).

As mentioned above, since the toner of the present invention is prepared by dissolving the resin A in aqueous phase liquid using an alkali, the particle diameter and charge quantity of the toner are substantially constant, and therefore the toner can produce good images over a long period of time. By contrast, the particle diameter and charge quantity of comparative toners prepared by using a particulate resin A vary when the particle diameter of the particulate resin A varies due to change of the manufacturing conditions, etc., and therefore the comparative toners produce images with background development.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2010-047670, filed on Mar. 4, 2010, the entire contents of which are herein incorporated by reference.

What is claimed is:

1. A method for preparing a toner including toner particles, comprising:

preparing a toner component liquid including at least a binder resin, a colorant and an organic solvent;

mixing at least a resin A having a solubility of less than 2.0 g/100 g in water having a pH of 3.0 at 25° C. while having a solubility of not less than 2.0 g/100 g in water having a pH of 10.0 at 25° C., a basic material, and water to prepare an aqueous phase liquid, in which the resin A is dissolved;

forming droplets of the toner component liquid in the aqueous phase liquid; and removing the organic solvent from the droplets of the toner component liquid to prepare the toner particles.

2. The method according to claim 1, wherein the resin A includes a first unit obtained from a monomer 1 having the following formula (1) and a second unit obtained from a monomer 2 having the following formula (2):

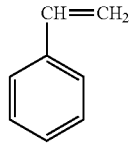

(1)

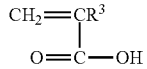

(2)

wherein $R^3$ represents a hydrogen atom or a methyl group, wherein the first unit is included in the resin A in an amount of from 20 to 80% by weight, and the second unit is included in the resin A in an amount of from 15 to 65% by weight.

3. The method according to claim 2, wherein the resin A further includes a third unit obtained from a monomer 3 having the following formula (3):

(3)

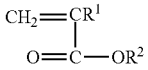

wherein $R^1$ represents a hydrogen atom or a methyl group, and $R^2$ represents a hydrocarbon group having 1 to 22 carbon atoms.

4. The method according to claim 2, wherein the resin A further includes a third unit obtained from a monomer 4 having the following formula (4):

(4)

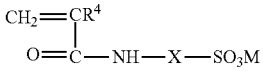

wherein $R^4$ represents a hydrogen atom or a methyl group, X represents a divalent hydrocarbon group, and M represents a hydrogen atom, a sodium atom, a potassium atom or a hydrocarbon group having 1 to 4 carbon atoms.

5. The method according to claim 2, wherein the aqueous phase liquid preparation step includes:

reacting a monomer composition including the monomers 1 and 2 in an aqueous medium including a surfactant using a water soluble radical generating agent to prepare a dispersion of the resin A having a solubility of less than 2.0 g/100 g in water having a pH of 3.0 at 25° C. while having a solubility of not less than 2.0 g/100 g in water having a pH of 10.0 at 25° C.; and mixing at least the dispersion of the resin A, a basic material, and water to prepare an aqueous phase liquid, in which the resin A is dissolved.

6. The method according to claim 2, wherein the aqueous phase liquid preparation step includes:

reacting a monomer composition including the monomers 1 and 2 dissolved in a solvent, in which a radical generating agent is dissolved, to prepare a resin A having a solubility of less than 2.0 g/100 g in water having a pH of 3.0 at 25° C. while having a solubility of not less than 2.0 g/100 g in water having a pH of 10.0 at 25° C.; and mixing at least the resin A, a basic material, and water to prepare an aqueous phase liquid, in which the resin A is dissolved.

7. The method according to claim 1, wherein the binder resin has a polyester unit.

8. The method according to claim 7, wherein the binder resin having a polyester unit has an acid value of from 2 to 24 mgKOH/g.

9. The method according to claim 7, wherein the binder resin having a polyester unit is a polyester resin.

10. The method according to claim 1, wherein the toner component liquid further includes a resin having an isocyanate group at an end thereof, which is dissolved in the organic solvent.

11. The method according to claim 10, wherein the resin having an isocyanate group at an end thereof has a polyester unit.

12. The method according to claim 10, wherein the toner component liquid further includes an amine compound having a di- or more-valent amino group reactive with the isocyanate group of the resin.

13. The method according to claim 1, wherein the basic material is a compound having a cation selected from the group consisting of alkali metal cations, and alkali earth metal cations, and an anion selected from the group consisting of $OH^-$, $COO^{2-}$, $HCOO^-$, $PO_4^{3-}$, $HPO_4^{2-}$, and $H_2PO_4^-$.

14. A toner comprising toner particles including a binder resin and a colorant, wherein the toner is prepared by the method according to claim 1.

15. A developer comprising the toner according to claim 14 and a carrier.

16. An image forming apparatus comprising:

an image bearing member;

a charger to charge a surface of the image bearing member;

an irradiator to irradiate the charged image bearing member with light based on image data to form an electrostatic latent image on the surface of the image bearing member;

a developing device to develop the electrostatic latent image with a developer including the toner according to claim 14 to form a toner image on the image bearing member;

a transferring device to transfer the toner image onto a recording material; and a fixing device to fix the toner image on the recording material.

17. The image forming apparatus according to claim 16, further comprising:

a toner supplying device to supply the toner from a toner container to the developing device.

18. An image forming method comprising:

charging a surface of an image bearing member;

irradiating the charged image bearing member with light based on image data to form an electrostatic latent image on the surface of the image bearing member;

developing the electrostatic latent image with a developer including the toner according to claim 14 to form a toner image on the image bearing member;

transferring the toner image onto a recording material; and fixing the toner image on the recording material.

19. The image forming method according to claim 18, further comprising:

supplying the toner from a toner container to the developer.

* * * * *